US008306464B2

(12) United States Patent
Maeyama et al.

(10) Patent No.: US 8,306,464 B2
(45) Date of Patent: Nov. 6, 2012

(54) DEVELOPMENT DEVICE AND IMAGE FORMING APPARATUS USING THE SAME

(75) Inventors: Takeshi Maeyama, Ikeda (JP); Toshiya Natsuhara, Takarazuka (JP); Junya Hirayama, Takarazuka (JP); Shigeo Uetake, Takatsuki (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 358 days.

(21) Appl. No.: 12/776,752

(22) Filed: May 10, 2010

(65) Prior Publication Data

US 2010/0290820 A1 Nov. 18, 2010

(30) Foreign Application Priority Data

May 12, 2009 (JP) ..... 2009-115346

(51) Int. Cl.
*G03G 15/08* (2006.01)

(52) U.S. Cl. ..... 399/282

(58) Field of Classification Search ..... 399/272, 399/277, 281, 282
See application file for complete search history.

(56) References Cited

U.S. PATENT DOCUMENTS 5,953,570 A * 9/1999 Hirai ..... 399/282
2007/0122209 A1* 5/2007 Okada et al. ..... 399/282

FOREIGN PATENT DOCUMENTS

JP 05-150636 6/1993
JP 2003-316155 11/2003

* cited by examiner

*Primary Examiner* — Sandra Brase
(74) *Attorney, Agent, or Firm* — Brinks Hofer Gilson & Lione

(57) ABSTRACT

Provided is a development device and an image forming apparatus both using a hybrid development method and capable of forming high quality images without occurrence of development hysteresis (ghost). The nip portion of the toner carrier and the developer carrier is configured as follows: the rotating direction of a toner carrier and a developer carrier are in counter directions; a magnetic pole facing the toner carrier is positioned on the upstream side in the developer carrier rotating direction; and a counter charge generated by the toner supply reaches a toner recovering portion without being considerably attenuated.

4 Claims, 7 Drawing Sheets

DEVELOPMENT DEVICE AND IMAGE FORMING APPARATUS USING THE SAME

This application is based on Japanese Patent Application No. 2009-115346 filed on May 12, 2009, in Japanese Patent Office, the entire content of which is hereby incorporated by reference.

TECHNICAL FIELD

The present invention relates to a development device including: a plurality of toner carriers for developing a latent image formed on an image carrier using a toner carried and conveyed on the surface thereof; and a developer carrier for supporting developer thereon and conveying the developer to supply toner in the developer to the aforementioned toner carriers. The present invention also relates to an image forming apparatus provided with the aforementioned development device.

BACKGROUND

In an image forming apparatus using an electrophotographic method, a single-component developing method using toner alone as developer and a two-component developing method using both toner and carrier as developer have been known as a development method for developing an electrostatic latent image formed on an image carrier.

In the single-component developing method, generally, toner is made to pass through a regulating section formed by a toner carrier and a regulating plate pressed against the toner carrier, whereby the toner is charged and a desired thin toner layer is obtained. This method has advantages of simplification, downsizing and cost reduction of the apparatus.

In the meantime, toner deterioration tends to be accelerated by the heavy stress at the regulating section, and toner charge-acceptance ability tends to be reduced. Further, the regulating member as a charge providing member for providing charge to the toner and the surface of the toner carrier are contaminated with the toner or external additive agent, whereby the charge-providing ability for providing charge to the toner is also reduced. This will reduce the amount of toner charge and will cause fogging and related problems, with the result that the service life of the development device is reduced.

Comparison reveals that, the two-component developing method is advantageous to realize a longer service life since the toner is mixed with a carrier to be charged by triboelectric charging, thereby causing less stress, and since the carrier is not easily contaminated with toner or external additives because of a greater area of its surface.

However, in the two-component developing method, when an electrostatic latent image on the image carrier is to be developed, the image carrier surface is brushed by a magnetic brush formed of the developer. This may create a problem that a mark of the magnetic brush remains on a developed image. Further, the carrier tends to be attached to the image carrier, whereby an image defect occurs.

The so-called hybrid development method was disclosed (e.g., Japanese Patent Application Publication No. H05-150636) as a development method that provides image quality as high as that of the single-component developing method, and solves the problem of image defect, and this method is characterized by a long service life achieved by the two-component developing method using a two-component developer. In this hybrid development method, a two-component developer is carried on the developer carrier, and only the toner is supplied from the two-component developer to the toner carrier.

However, the hybrid development method described in the Japanese Patent Application Publication No. H05-150636 includes an issue of development hysteresis (ghost) as described below.

The issue of development hysteresis (ghost) is an issue, which the hybrid development method generally has, and in which post-development residual toner which is not used for development is deposited on an image as a development hysteresis (ghost), in the next development step.

At the facing portion (toner supplying and recovering area) of the toner carrier and the developer carrier provided to supply toner to the toner carrier, a bias is applied to supply the toner, and the recovering of the post-development residual toner is also carried out at the same facing portion to the developer carrier.

As above-mentioned, a bias voltage applied in the supplying direction for supplying the toner in the supplying-recovering zone; such a constitution becomes as the factor hindering the toner recovery so that the toner recovering ability becomes insufficient. Consequently, a portion having larger amount of the post-development residual toner and a portion having smaller amount of the post-development residual toner appears as a contrast of density at the next developing process.

Techniques for reducing such a development hysteresis (ghost) have been developed particularly in the constitution of the facing zone (nip portion) of the developer carrier for supplying (and recovering) the toner and the toner carrier (refer to, for example, Unexamined Japanese Patent Application Publication 2003-316155).

In the development device described in Unexamined Japanese Patent Application Publication 2003-316155, the following setting is disclosed as a constitution of a nipping portion (toner supplying-recovering area): the rotating direction of the developing roller (toner carrier) and that of the magnetic brush roller (developer carrier) are opposite to each other; and the position of magnetic pole of the magnetic brush roller facing the developing roller is shifted at 0 to 15° toward the upstream of the rotating direction of the magnetic brush roller from the closest position.

As above-mentioned, the constitution capable of maintaining both of the toner supplying ability and toner recovering ability at the nip portion at an appropriate level is required for reducing the occurrence of development hysteresis (ghost).

In the development device described in Unexamined Japanese Patent Application Publication 2003-316155, the nip portion is separated into the toner supplying portion and the toner recovering portion by setting the rotating direction of the toner carrier and the toner carrier to be opposite.

Moreover, the toner supplying ability on the entrance side of the toner supplying nip portion is improved by positioning the brushing peak of the magnetic brush on the upstream side of the rotating direction of the developer carrier from the closest position.

Supplying toner from the developer generates counter charge opposite to the toner charge in the developer. The counter charge hinders the supply of toner. Since the counter charge generation is unavoidable, therefore, the constitution described in Unexamined Japanese Patent Application Publication 2003-316155 is configured so that most of the toner is supply at the initial period of generation of counter charge in the toner supplying portion, thereby keeping the toner supplying ability.

On the other hand, the counter charge accelerates the recovery of toner. However, according only to the configuration described in Unexamined Japanese Patent Application Publication 2003-316155, the generated counter charge is not effectively utilized in the toner recovering portion, there failing to achieve sufficient toner recovering ability.

Therefore, the occurrence of the development hysteresis (ghost) is sufficiently reduced with that configuration.

SUMMARY

The present invention is conceived based on the above technical subject, and an object of the invention is to provide a development device and an image forming apparatus, which output a high quality image in which the occurrence of development hysteresis (ghost) is reduced.

In view of forgoing, one embodiment according to one aspect of the present invention is a development device, comprising:

a toner carrier for carrying toner on a surface thereof and conveying the toner to develop an electrostatic latent image formed on an image carrier with the toner; and a developer carrier rotatably provided facing the toner carrier to form a nip portion between the developer carrier and the toner carrier, the developer carrier including:

a stationarily provided magnet body; and a sleeve roller rotatably provided containing therein the magnet body, the sleeve roller carrying and conveying on a surface thereof, which is a surface of the developer carrier, the developer containing toner and carrier, and configured to supply the toner in the developer to the toner carrier at the nip portion by an electric field while rubbing a surface of the toner carrier with a magnetic brush which is formed of the developer by magnetism of a magnetic pole of the magnet body, wherein the development device is configured to satisfy the following three conditions:

a moving direction of the surface of the developer carrier is opposite, at the nip portion, to a moving direction of the surface of the opposing toner carrier;

the magnetic pole of the magnet body is positioned facing the nip portion so that a peak of a distribution of a magnetic flux density of the magnetic pole is positioned in a range of location where the magnetic brush rubs the surface of the toner carrier, and so that the peak is positioned on an upstream side in a rotating direction of the developer carrier from a closest position at which the toner carrier and the developer carrier are closest to each other; and at the nip portion, the following relationship is satisfied:

$$T/\tau<1$$

wherein:

T is a time period needed for a certain portion of the surface of the developer carrier to pass through an area in which the magnetic brush rubs the surface of the toner carrier in the nip portion; and τ is an attenuation time constant to be used to express an attenuation of a surface potential V(t) generated by a charge caused by the supplying of toner from the developer, in the following equation:

$$V(t)=V0\times\exp(-t/\tau)$$

wherein:

V0 is the surface potential of the developer, at a time t=0, generated by the supply of toner; and V(t) is the surface potential of the developer at a time t.

According to another aspect of the present invention, another embodiment is an image forming apparatus, comprising:

an image carrier; and a development device for developing an electrostatic latent image formed on the image carrier, the development device including:

a toner carrier for carrying toner on a surface thereof and conveying the toner to develop an electrostatic latent image formed on an image carrier with the toner; and a developer carrier rotatably provided facing the toner carrier to form a nip portion between the developer carrier and the toner carrier, the developer carrier including:

a stationarily provided magnet body; and a sleeve roller rotatably provided containing therein the magnet body, the sleeve roller carrying and conveying on a surface thereof, which is a surface of the developer carrier, the developer containing toner and carrier, and configured to supply the toner in the developer to the toner carrier at the nip portion by an electric field while rubbing a surface of the toner carrier with a magnetic brush which is formed of the developer by magnetism of a magnetic pole of the magnet body, wherein the development device is configured to satisfy the following three conditions:

a moving direction of the surface of the developer carrier is opposite, at the nip portion, to a moving direction of the surface of the opposing toner carrier;

the magnetic pole of the magnet body is positioned facing the nip portion so that a peak of a distribution of a magnetic flux density of the magnetic pole is positioned in a range of location where the magnetic brush rubs the surface of the toner carrier, and so that the peak is positioned on an upstream side in a rotating direction of the developer carrier from a closest position at which the toner carrier and the developer carrier are closest to each other; and at the nip portion, the following relationship is satisfied:

$$T/\tau<1$$

wherein:

T is a time period needed for a certain portion of the surface of the developer carrier to pass through an area in which the magnetic brush rubs the surface of the toner carrier in the nip portion; and τ is an attenuation time constant to be used to express an attenuation of a surface potential V(t) generated by a charge caused by the supplying of toner from the developer, in the following equation:

$$V(t)=V0\times\exp(-t/\tau)$$

wherein:

V0 is the surface potential of the developer, at a time t=0, generated by the supply of toner; and V(t) is the surface potential of the developer at a time t.

BRIEF DESCRIPTION OF THE DRAWINGS

FIG. 7 shows a graph in which the values of $T/\tau$ of Tables 1 and 2 are plotted on the lateral axis and calculated values of remaining ratio of surface potential corresponding to them are plotted on the vertical axis, and the evaluation results of ghost are filled in;

DETAILED DESCRIPTION OF THE PREFERRED EMBODIMENT

The following describes an embodiment of the present invention with reference to the drawings.

(Structure and Operation of the Image Forming Apparatus)

Figure 1:
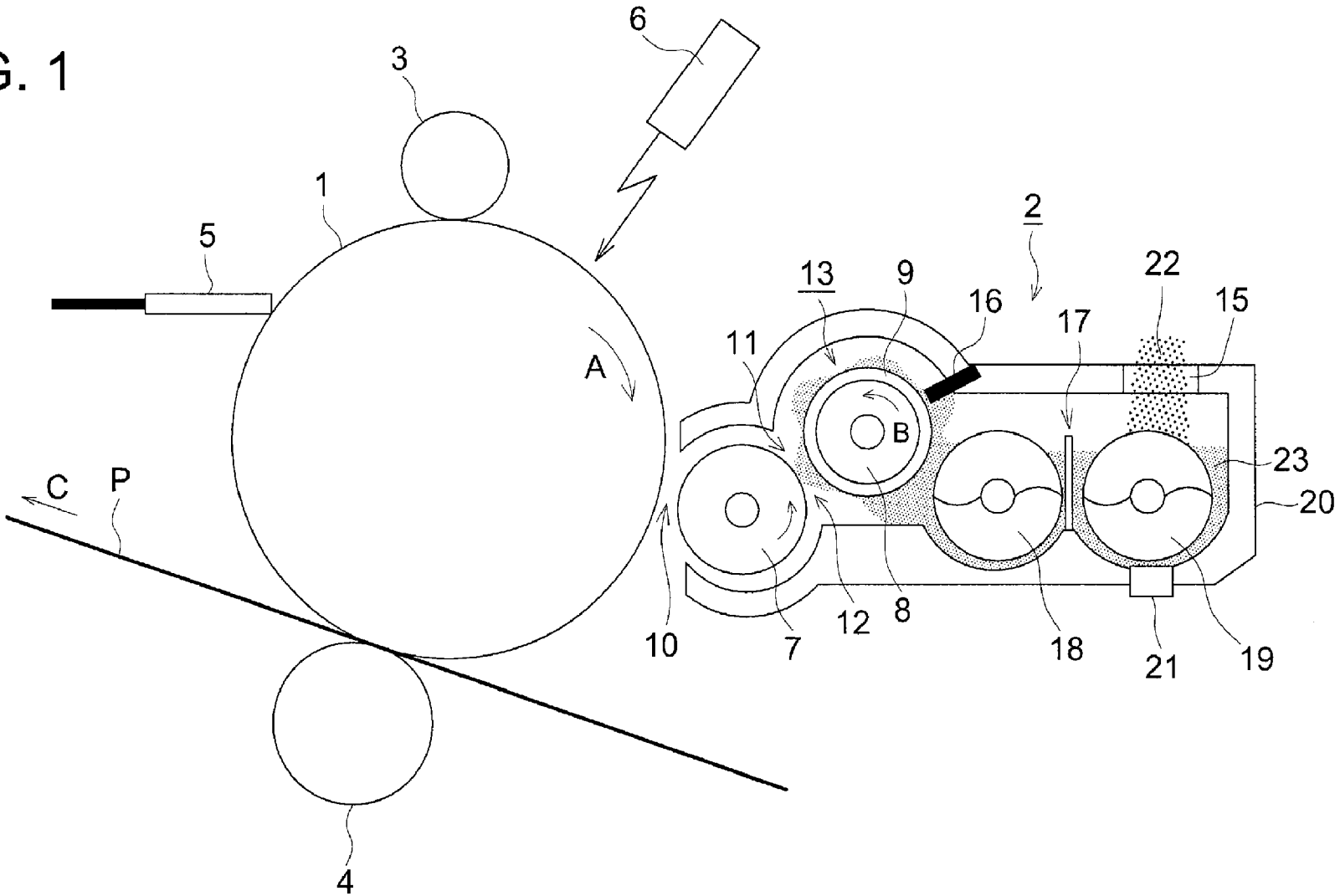
FIG. 1 is a cross section illustrating an example of a constitution of an image forming apparatus of an embodiment according to the invention.

FIG. 1 is a diagram representing a structural example of the major portion of an image forming apparatus according to an embodiment of the present invention. The following describes the schematic structure and operation of the image forming apparatus in this embodiment with reference to FIG. 1.

This image forming apparatus is a printer where a toner image formed on an image carrier (photoreceptor) 1 by the electrophotographic method is transferred onto a transfer medium P such as a sheet of paper, whereby an image is formed.

This image forming apparatus includes the image carrier 1 for carrying an image, and around the image carrier there are arranged along the rotating direction A of the image carrier a charging member 3 as a charging means for charging the image carrier 1, a development device 2 for developing an electrostatic latent image on the image carrier 1 to form a toner image, a transfer roller 4 for transferring a toner image on the image carrier 1, and a cleaning blade 5 for removing the toner remaining on the image carrier 1.

After having been charged by a charging member 3, the image carrier 1 is exposed to light by an exposure device 6 equipped with a laser emitting device, and thereby an electrostatic latent image is formed on the surface thereof. The development device 2 develops this electrostatic latent image so that a toner image is formed. After transferring the toner image on the image carrier 1 onto the transfer medium P, the transfer roller 4 ejects the transfer medium P in the direction of arrow C in FIG. 1. The cleaning blade 5 uses the mechanical force to remove the post-development residual toner remaining on the image carrier 1.

For the image carrier 1, charging member 3, exposure device 6, transfer roller 4 and cleaning blade 5 used in the image forming apparatus, any conventionally known electrophotographic technology can be used. For example, although a charging roller is shown in the drawing as a charging device, an image carrier 1 or non-contact charging device can be used. Further, a cleaning blade need not be used.

The following describes the structure of the basic portion of the development device 2 using the hybrid development method according to the present embodiment.

The development device 2 includes: a developer tank 17 for storing the developer 23 containing carrier and toner; a developer carrier 13 whose surface is used to carry and convey the developer 23 supplied from the developer tank 17; and a first toner carrier 7 for developing the electrostatic latent image formed on the image carrier 1 to which only toner is supplied from the developer carrier 13.

The details of the structure and operations of the development device 2 will be described later.

(Structure of the Developer)

The following describes the structure of the developer used in the development device according to the present embodiment.

The developer 23 used in the present embodiment includes toner and carrier for charging the toner.

<Toner>

There is no particular restriction to the toner. Known toner commonly used can be utilized. Binder resin is impregnated with a coloring agent or, if required, with an electric charge control agent or a mold releasing agent, and is treated with an external additive agent. This product can be used as the toner. The diameter of toner particles is preferably from about 3 to 15 μm without being restricted thereto.

The aforementioned toner can be produced by the known method commonly used. For example, the pulverization method, emulsion polymerization method or suspension polymerization method can be used.

The binder resin to be used for the toner is exemplified by styrene based resin (homopolymer or copolymer including a substituted styrene or styrene), polyester resin, epoxy based resin, vinyl chloride resin, phenol resin, polyethylene resin, polypropylene resin, polyurethane resin, and silicone resin, without being restricted thereto. It is preferable to use the single substance or a complex of the aforementioned resins having a softening temperature from 80 to 160° C., or having a glass transition point from 50 to 75° C.

The known agent commonly use can be used as the coloring agent. Examples include carbon black, aniline black, activated carbon, magnetite, Beijing yellow, permanent yellow, naphthol yellow, phthalocyanine blue, first sky blue, ultra-marine blue, rose bengal, and lake red. They can be preferably used. Generally, the preferred ratio is from 2 to 20 parts by mass with respect to 100 parts by mass of the aforementioned binder resin.

The known material commonly used can be used as the aforementioned electric charge control agent. The electric charge control agent for positive charge toner is exemplified by a nigrosine based dye, quaternary ammonium salt based compound, triphenyl methane based compound, imidazole based compound and polyamine resin. The electric charge control agent for negatively charged toner is exemplified by metal-containing azo based dye such as Cr, Co, Al and Fe, metallic salicylate compound, metallic alkylsalicylate compound and calixarene compound. Generally, the preferred ratio of the electric charge control agent is from 0.1 to 10 parts by mass with respect to 100 parts by mass of the aforementioned binder resin.

The known agent commonly used can be used as the mold releasing agent. Polyethylene, polypropylene, carnauba wax or sazol wax can be used independently or in combination of two or more types. Generally, the preferred ratio is from 0.1 to 10 parts by mass with respect to 100 parts by mass of the aforementioned binder resin.

The known agent commonly used can be used as the aforementioned external additive agent. Examples include inorganic particles such as silica, titanium oxide and aluminum oxide, and such resin particles as acryl resin, styrene resin, silicone resin, and fluorine resin. Especially, the silane coupling agent, titanium coupling agent and silicone oil treated by hydrophobing are used with particular preference. It is preferred to add 0.1 through 5 parts by mass of such a superplasticizer with respect to 100 parts by mass of toner. The number average particle size of the external additive agent is preferably from 10 to 100 nm.

Particles charged oppositely to the toner can be used as the aforementioned external additive agent. Opposite polarity particles that are used preferably are selected as appropriate according to the polarity of the charged toner.

For example, when the toner is charged negative by the carrier, the opposite polarity particles are positive charged particles which area charged positive in the developer. Alternatively, when the toner is charged positive by the carrier, the opposite polarity particles are positive charge particles which are charged positive in the developer. When the opposite polarity particles are included in the two-component developer so that the opposite polarity particles are accumulated in the developer with work time of operation, the deterioration of the carrier is reduced. That is because even if the charging properties of the carrier is lowered by the contamination of the carrier with toner and post-process agents, the opposite polarity particles charge the toner to the predetermined polarity and thereby compensating the charging properties of the carrier.

When a negative charge toner is used, positive charge particles are used as opposite polarity particles. They are exemplified by the particles made of inorganic particles of strontium titanate, barium titanate and alumina, thermoplastic resins including acryl resin, benzoguanamine resin, nylon resin, polyimide resin and polyamide resin, or thermosetting resins. Further, the resin can contain a positive charge control agent for providing a positive charge, or a copolymer of nitrogen-containing monomer can be formed.

Nigrosine dye or quaternary ammonium salt can be used as the aforementioned positive charge control agent, and 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole or vinyl imidazole can be used as the aforementioned nitrogen-containing monomer.

On the other hand, when a positive charge toner is used, negative charge particles can be employed as opposite polarity particles. For example, in addition to the inorganic particles of silica, titanium oxide or others, it is possible to utilize the particles made of a thermoplastic resin such as fluorine resin, polyolefin resin, silicone resin and polyester resin, or the thermosetting resin. Alternatively, the resin can be impregnated with a negative charge control agent for providing negative charge. It is also possible to constitute a copolymer made of fluorine-containing acryl based monomer and fluorine-containing methacrylate based monomer. For example, the salicylic based acid, the naphthol based chromium complex, aluminum complex, iron complex or zinc complex can be used as the aforementioned negative charge control agent.

To regulate the charging properties and hydrophobicity of the opposite polarity particles, the surface of the inorganic particles can be treated with a silane coupling agent, titanium coupling agent or silicone oil. Especially in order to provide inorganic particles with positive charge property, surface treatment with an amino acid-containing coupling agent is preferably provided. In order to provide inorganic particles with negative charge property, surface treatment with a fluorine group-containing coupling agent is preferably provided.

Opposite polarity particles preferably have a number average particle size from 100 to 1000 nm, and are preferably added at the ratio from 0.1 to 10 parts by mass with respect to 100 parts by mass of toner.

<Carrier>

The known carrier commonly used can be used as the carrier without being restricted thereto. A binder type carrier or coat-type carrier can be used. The preferred diameter of the carrier is from 15 to 100 μm without being restricted thereto.

The binder type carrier is made of particles of magnetic substance dispersed in the binder resin. Positive or negative charge particles can be bonded onto the carrier surface, or a surface coating layer can be formed. The charging properties such as polarity of the binder type carrier can be controlled by adjusting the material of the binder resin, electrostatic particles and the type of surface coating layer.

The binder resin used in the binder type carrier is exemplified by thermoplastic resin such as the vinyl based resin represented by polystyrene based resin, polyester based resin, nylon based resin and polyolefin based resin, as well as thermosetting resin such as a phenol resin.

The magnetic particles of the binder type carrier that can be employed include particles of magnetite, spinel ferrite such as gamma iron oxide, spinel ferrite containing one or more types of metals (e.g., Mn, Ni, Mg and Cu) other than iron, magnetoplumbite type ferrite such as barium ferrite, and the iron or alloy having an oxide layer on the surface. These particles can be formed in any configuration-granular, globular or, acicular. Especially when a high degree of magnetic force is required, iron based ferromagnetic particles are preferably used. Further, when consideration is given to the chemical stability, it is preferred to use the ferromagnetic particles of magnetoplumbite type ferrite such as magnetite, spinel ferrite containing gamma iron oxide or barium ferrite. A magnetic resin carrier characterized by a desired magnetism can be produced by proper selection of the type and amount of ferromagnetic particles to be contained therein. The preferred amount of the magnetic particles to be added into the magnetic resin carrier is from 50 to 90% by mass.

A silicone resin, acryl resin, epoxy resin or fluorine based resin is used as the surface coating material of the binder type carrier. When these resins are coated and hardened on the surface to form a coating layer, the charge-providing ability is improved.

In the process of bonding electrostatic particles or conductive particles onto the surface of the binder type carrier (the magnetic resin carrier), the magnetic resin carrier is uniformly mixed with those particles to be bonded to attach those particles onto the surface of the magnetic resin carrier. After that, mechanical or thermal impact is applied so that the particles are injected into the magnetic resin carrier and are fixed in position. In this case, the particles are not completely embedded into the magnetic resin carrier. Instead, part of the particles is kept protruded from the surface of the magnetic resin carrier.

Organic or inorganic insulating materials are used as electrostatic particles. To put it more specifically, examples of the organic material include organic insulating particles made of polystyrene, styrene based copolymer, acryl resin, various forms of acryl copolymer, nylon, polyethylene, polypropylene, and fluorine resin or cross-linked substances thereof. A desired degree of charging and polarity can be obtained by the selection of proper materials, use of a polymerization catalyst and surface treatment. Examples of the inorganic material include negative charge inorganic particles made of silica or titanium dioxide, and positive charge particles made of strontium titanate or alumina.

On the other hand, the coat-type carrier is formed of resin-coated carrier core particles of magnetic substances. Similarly to the case of the binder type carrier, the coat-type carrier is formed by the process of bonding the positive or negative charge particles to the carrier surface. The charging properties of the coat-type carrier such as polarity can be controlled by proper selection of the type of the surface coating layer and electrostatic particles. The same material as that of the binder type carrier can be used. The same resin as the binder resin of the binder type carrier can be used as the coated resin, in particular.

The mixture ratio of the toner to carrier should be adjusted to get a desired amount of toner charge. The toner mixture ratio is from 3 to 50% by mass, preferably, 6 to 30% by mass with respect to the total amount of toner and carrier.

(Structure and Operation of Development Device 2)

Referring to FIG. 1, the following describes the details of the structure and operation of the development device 2 in the present embodiment.

<Apparatus Structure>

As described above, the developer 23 used in the development device 2 is made of toner and carrier and is stored in a developer tank 17.

The developer tank 17 is made of a casing 20. Mixing/stirring members 18 and 19 are generally incorporated in the developer tank 17. The mixing/stirring members 18 and 19 are used to mix and stir the developer 23, and to supply the developer 23 to a developer carrier 13. An ATDC (Automatic Toner Density Control) sensor 21 for toner density detection is preferably installed on the casing 20 at the position opposed to the mixing/stirring member 19.

The development device 2 generally includes a replenishment section 15 for replenishing into the developer tank 17 the amount of toner to be consumed by the image carrier 1. In the replenishment section 15, the replenishment toner 22 supplied from a hopper (not illustrated) incorporating the replenishment toner is supplied into the developer tank 17.

The development device 2 is provided with a regulating member 16 for reducing the thickness of the developer and regulating the amount of developer on the developer carrier 13.

The developer carrier 13 is normally made of a magnetic roller (magnet body) 8 fixedly disposed in position, and a freely rotatable sleeve roller 9 containing the roller 8. In the image formation mode, a toner supply bias voltage is applied to supply toner to the toner carrier 7.

The toner carrier 7 is arranged facing both the developer carrier 13 and image carrier 1, and a development bias voltage is applied to develop the electrostatic latent image on the image carrier 1.

The toner carrier 7 can be made of any material, as long as the aforementioned voltage can be applied. Examples include an aluminum roller provided with surface treatment exemplified by alumite. Further, the toner carriers can be made of the conductive substrate of aluminum that is coated with resin such as polyester resin, polycarbonate resin, acryl resin, polyethylene resin, polypropylene resin, urethane resin, polyamide resin, polyimide resin, polysulfone resin, polyether ketone resin, vinyl chloride resin, vinyl acetate resin, silicone resin or fluorine resin; or is coated with rubber such as silicone rubber, urethane rubber, nitrile rubber, naturally-occurring rubber or isoprene rubber. In this case, the coating material is not restricted to these materials.

Further, a conductive agent can be added to the bulk or surface of the aforementioned coating. The conductive agent is exemplified by an electron-conductive agent and ion-conductive agent. Examples of the electron-conductive agent include carbon black such as Ketzin black, acetylene black and furnace black; metallic powder; and particles of metallic oxides without the conductive agent being restricted thereto. Examples of ion-conductive agents include cationic compound such as quaternary ammonium salt, amphoteric compound, and other ionic polymeric materials without the ionic conductive agent being restricted thereto. Further, a conductive roller made of a metallic material such as aluminum can be used.

<Operation of Apparatus>

The following describes an example of operation of the development device 2 shown in FIG. 1 in detail.

The developer 23 in the developer tank 17 is mixed and stirred by the rotation of the mixing/stirring members 18 and 19, and is subjected to triboelectric charging. At the same time, the developer 23 is circulated inside the developer tank 17 to be supplied to a sleeve roller 9 on the surface of the developer carrier 13.

The developer 23 is held on the surface of the sleeve roller 9 by the magnetic force of the magnetic roller 8 inside the developer carrier 13, and is rotated and moved together with the sleeve roller 9, and the amount of the developer 23 is then regulated by the regulating member 16 disposed facing the developer carrier 13.

After that, the developer 23 is conveyed to a supply nip portion where the developer carrier 13 and toner carrier 7 are opposed to each other.

In the supply nip portion, the rotating directions of the toner carrier 7 and the developer carrier 13 are set such that their surfaces move in the opposite directions. Regarding the magnet pole which is one of the magnet poles arranged in the magnet roller 8 of the developer carrier 13 and is facing the toner carrier is arranged so that the position of the peak of the magnetic flux is positioned on the upstream side in the rotating direction of the developer carrier 13, from the center of the supply nip portion.

The effect, of reducing the development hysteresis (ghost), generated by the synergistic effect of the above described arrangement will be described later.

In the toner supply area 11, which is a portion, upstream from the center of the nip portion in the rotating direction of the toner carrier 13, and which is in the opposing portion where the toner carrier 7 faces the developer carrier 13, the toner in the developer 23 is supplied to the toner carrier 7 by a force given to the toner by the electric field formed by the potential difference between the development bias voltage applied to the toner carrier 7 and toner supply bias voltage applied to the developer carrier 13.

Generally, the toner carrier 7 is applied with a bias in which an AC voltage is superposed on the DC voltage, and the developer carrier 13 is applied with a bias of a DC voltage alone, or a bias in which an AC voltage is superposed on the DC voltage. Thus, in the toner supply area 11, there is formed an electric field of an AC electric field superposed on a DC electric field.

In the toner recovery area 12, which is a portion located upstream, from the center of the nip portion, in the rotating direction of the toner carrier, and which is in the opposing portion where the toner carrier 7 faces the developer carrier 13, the post-development residual toner is collected by a collecting action which is caused to the post-development residual toner by the developer 23 on the developer carrier 13.

The toner layer supplied onto the toner carrier 7 from the developer carrier 13 in the toner supply area 11 is conveyed to the development area 10 by the rotation of the toner carrier 7. This toner layer is used for development by the electric field formed by the development bias voltage applied to the toner carrier 7 and the potential of the latent image on the image carrier 1.

In the development area 10, development is performed with the toner moved by the electric field through the development space between the toner carrier 7 and image carrier 1.

Various forms of known bias can be used as the development bias voltage. The bias generally applied is a bias in which an AC voltage is superposed on a DC voltage. After that, the toner layer remaining (post-development residual toner) subsequent to development from which toner has been consumed in the development area 10 is conveyed to the toner recovery area 12 by the rotation of the toner carrier 7.

The post-development residual toner conveyed to the toner recovery area 12 is recovered into the developer 23 by a mechanical recovering force caused by the developer 23 on the developer carrier 1 as already described, and by an electrical recovering force caused by a counter charge in the developer 23 as described later.

The developer 23 having passed through the toner recovery area 12 is conveyed to the developer tank 17 with the rotation of the sleeve roller 9, and is separated from the developer carrier 13 by the repulsive magnetic field provided on the magnetic roller at the position corresponding to the developer collection area. Then the developer 23 is collected into the developer tank 17.

When the replenishment control section (not illustrated) provided on the replenishment section 15 has determined from the output value of the ATDC sensor 21 that the toner concentration in the developer 23 is reduced below the minimum toner concentration required to ensure the image density, the replenishment toner 22 stored in the hopper is supplied, by the toner replenishment device (not illustrated), into the developer tank 17 through the toner replenishment section 15.

(Action in the Nip Portion)

Figure 2:
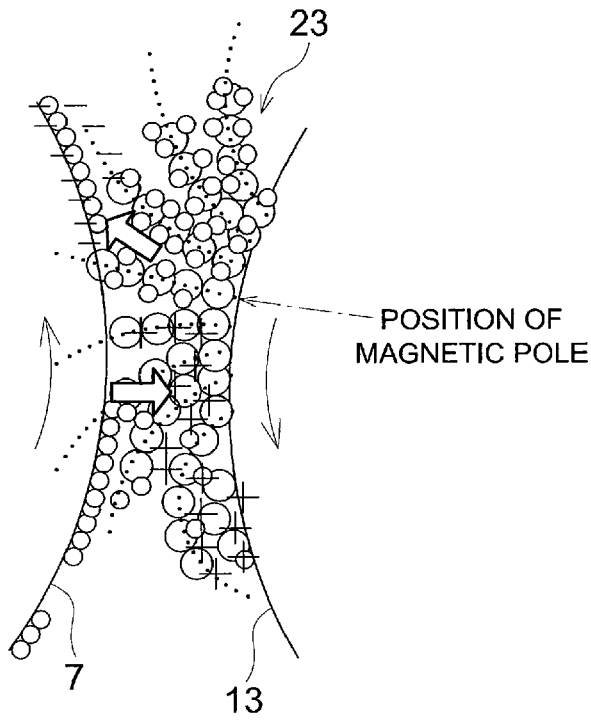
FIG. 2 is an enlarged schematic diagram showing a vicinity of the facing portion (nip portion) of a toner carrier 7 an developer carrier 13.

The phenomenon occurring at the toner supplying-recovering area near the portion, where the toner carrier is faced to the developer carrier, is described in detail bellow referring FIG. 2.

FIG. 2 shows an enlarged drawing schematically displaying the phenomenon occurring in the facing zone (nip portion) of the toner carrier 7 to the developer carrier 13. At the toner supplying-recovering portion in the nip portion, the toner supplying to the toner carrier 7 and the toner recovery from the toner carrier 7 are performed.

The supply of the toner is carried out by transferring the toner to the toner carrier 7 from the developer 23 on the developer carrier 13 by the action of the electric field formed by the toner supplying bias voltage (the difference between the average potential of the toner carrier 7 and that of the developer carrier 13) applied between the toner carrier 7 and the developer carrier 13 on the occasion of entering the developer 23 on the developer carrier 13 into the facing zone to the toner carrier 7.

When the toner is supplied by the electric field, the toner is moved through the carrier and reaches the toner carrier 7. The toner can be easily moved through the carrier because a magnetic bristle of the carrier of the magnet brush is formed in the vicinity just above the magnet pole provided in the magnet roller 8 of the developer carrier 13 and spaces are formed among the carrier particles.

On the other hand, no magnetic bristle is formed on the portion other than the portion near upon the magnetic pole and the spaces among the toner particles are reduced; therefore the toner has difficulty moving through the carrier.

For the above reason, the supply of the toner is mainly performed in the vicinity just above the magnetic pole in the facing zone of the toner carrier 7 and the developer carrier 13.

The toner on the toner carrier 7 is mainly mechanically recovered by scraping with the magnetic brush formed on the developer carrier 13.

The toner recovering action mainly occurs in the region (the toner recovering portion 12) between the downstream end in the rotation direction of the developer carrier 13 and the center of the supply nip portion where the contact is made strongest.

In the region (the toner supplying portion 11) between the upstream end in the rotation direction of the developer carrier 13 and the center of supply nip portion, the toner is only supplied to the toner carrier 7 from the developer 23 transferred on the surface of developer carrier 13 (the upper open arrow in FIG. 2).

When the polarity of the toner is negative, the negatively charged toner is only transferred from the developer 23 to the toner carrier 7; therefore the electric neutrality in the developer is lost near the surface of the developer 23 from which the toner has been removed, thus the positive charge held by the carrier excessively exists. The positive charge excessively existing in the developer 23 after supplying the toner is called as a counter charge.

The counter charge acts to attract (the lower open arrow in FIG. 2) the negatively charged toner remaining after development when the counter charge is moved without disappearing from the developer 23 to the toner recovering portion 12 for a reason such as the resistance of the carrier being high. Consequently, the counter charge contributes to the recovering of the post-development residual toner and advantageously effects on the problem of ghost.

(Constitution of the Nip Portion and the Toner Recovery Accelerated by the Counter Charge)

Constitution of the nip portion, the toner recovery accelerated by the counter charge, and the reduction of ghost occurrence are described below.

In a development device relating to the invention, a nip portion between a toner carrier 7 and a developer carrier 13 is constituted so as to satisfy the following conditions: first, the transferring direction of the developer 23 on the surface of the developer carrier 13 is counter to the moving direction of the surface of the toner carrier 7; second, a magnetic pole is provided in the nip portion and the peak of magnetic flux distribution is positioned within the range of rubbing with the magnetic brush, and is also positioned on the upstream side of rotating direction of the developer carrier 13 from the nearest position of the toner carrier 7 to the developer carrier 13; and third, the values of $\tau$ and T satisfy the relationship of $T/\tau<1$ wherein T is the time necessary for a certain point on the developer carrier 13 to pass through the range in which the surface of toner carrier 7 is rubbed with the magnetic brush formed on the developer carrier 13, and τ is the attenuation time constant of the surface potential caused by the charge generated on the developer 23 on the developer carrier 13.

Satisfying the above conditions provides the following advantages: the nip portion for supplying the toner is separated into a toner supplying portion 11 and a toner recovering portion 12 when rotating the toner carrier 7 and the developer carrier 13 in the counter direction to each other; and the toner supplying ability on the entrance side of the nip portion for supplying toner (the toner supplying portion 11) can be increased when the magnet pole is located to face the toner carrier on the upstream side of the rotating direction of the developer carrier 13. Namely, most of the toner is supplied in the initial period of generation of counter charge which hinders toner supply; the toner recovering ability is improved by suitably designing the relationship between the electric conductivity of carrier and the passing time of carrier passing through the nip portion so that the counter charge generated by supplying toner is conveyed to the toner recovering portion 12 brought without being considerably attenuated, thus the counter charge is kept sufficient to recover the post-development residual toner on the downstream side of the toner supplying nip portion (the toner recovering portion 12).

In the counter-rotation, the supply of toner is mainly carried out on the upstream side of the rotating direction of the developer carrier (the upper open arrow in FIG. 2) when the facing magnetic pole is located on the upstream side of the rotating direction.

With such an arrangement, the toner supplied to the toner carrier exits the supplying nip portion without going through the toner recovering portion is completely transferred to the toner carrier. Namely, the nip portion is separated into two portions, the supplying portion 11 and the recovering portion 12.

As a result, the above arrangement prevents the once supplied toner from passing through the toner recovering portion and from hindering the toner supply, with the result that the toner supplying ability is increased.

Such a high toner supplying ability will allow toner to be supplied by a relatively low supplying bias voltage.

The supplying bias voltage forms an electric field hindering the recovery of the post-development residual toner; therefore the lower bias voltage is preferable to increase the recovering ability. With the constitution of this embodiment, the increase of the supplying ability lowers the toner supply bias, thereby improving the recovering ability, and the development hysteresis (the ghost) is reduced.

Moreover, with the constitution of the development device according to the embodiment, the developer 23 after finishing the toner supply is conveyed from the toner supplying portion 11 to the toner recovering portion 12. On this occasion, the developer 23 is moved to the toner recovering portion 12 while maintaining the counter charge, if the above third condition $T/\tau<1$ is satisfied.

With the above-mentioned advantage, the post-development residual toner is recovered into the developer with high efficiency by the help of electrical recovering force (the lower open arrow in FIG. 2) in addition to the usual mechanical recovering force. From such a viewpoint, this constitution contributes to reducing the development hysteresis (ghost).

As above-mentioned, the supply of toner to the toner carrier and the post-development residual toner recovery from the toner carrier can be both accelerated at the nip portion with the developer carrier by the synergistic effect since the constitution is made so as to satisfy all the above three conditions.

As a result, the occurrence of the development hysteresis (ghost) is reduced and high quality images are formed.

(Attenuation of Counter Charge)

The attenuation of the counter charge is described in detail below.

The counter charge excessively left in the developer 23 after releasing the toner has a function of attracting the negatively charged post-development residual toner when the counter charge is conveyed to the toner recovering portion without being attenuated in the developer for the reason of the resistance of the carrier being high and the like. Therefore, the counter charge contributes to the recovery of the post-development residual toner and advantageously acts to resolve the problem of the development hysteresis (ghost).

In order for the counter charge to contribute to the toner recovering ability, it is necessary that the counter charge is kept in the carrier without considerably being attenuated while being conveyed from the toner supplying portion 11 to the recovering portion 12. Although the polarity of the toner is supposed to be negative in the above description, the same description can be applied by reversely thinking the polarity when the polarity of the toner is positive. The same thinking goes with the following description when the polarity is assumed to be a certain polarity.

Figure 3:
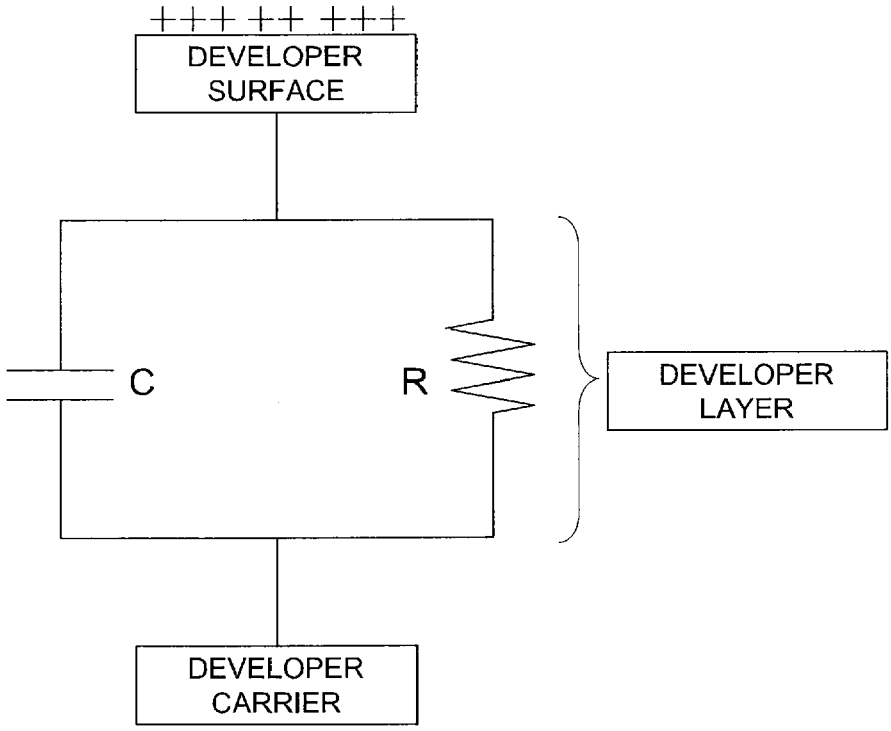
FIG. 3 shows an equivalent circuit of the developer layer 23 on the developer carrier 13.

The phenomenon of the attenuation of counter charge in the developer 23 is described below referring an equivalent circuit. FIG. 3 shows the equivalent circuit of the developer layer 23 on the developer carrier 13.

The surface of the developer layer 23 on the developer carrier 13 has positive counter charge after losing negative charge by releasing of the toner. The charge is attenuated with time by the time constant depending on the static capacitance and the resistance of the developer layer 23.

The situation of the attenuation in the equivalent circuit shown in FIG. 3 is expressed by the following equation.

$$V(t)=V0\times\exp(-t/CR)$$

where V0 is the voltage on the surface of the developer 23 caused by the counter charge, C is the static capacitance of the developer layer, and R is the resistance of the developer layer.

When the time constant CR in the above equation is referred to as the attenuation time constant and expressed as $CR=\tau$, the above equation can be described as follows.

$$V(t)=V0\times\exp(-t/\tau) \quad (1)$$

In the above Expression 1, the time t is substituted by T to convey the developer 23 from the entrance to exit of the supplying nip portion. In this case, what is needed for the counter charge to reach from the toner supplying portion 11 to the recovering portion 12 is that a coefficient of "$\exp(-T/\tau)$" (hereinafter, referred to as a surface potential remaining ratio) is not decreased substantially to zero, where C is a capacitance of the developer layer, and R is a resistance of the developer layer.

Figure 4:
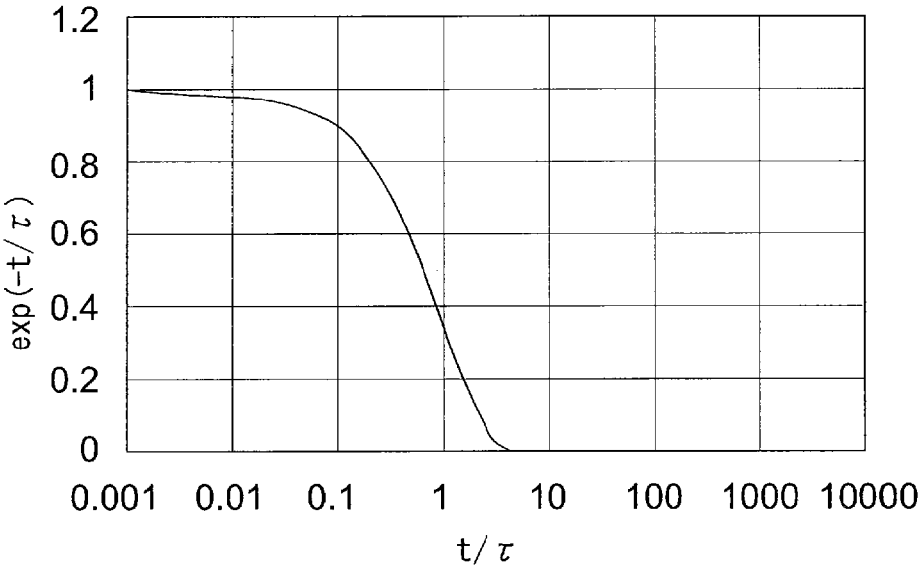
FIG. 4 is a graph illustrating a relation between $t/\tau$ in Expression 1 and a surface potential remaining ratio $\exp(-t/\tau)$.

FIG. 4 is a graph showing the relationship between $t/\tau$ in Equation 1 and the surface potential remaining ratio $\exp(-t/\tau)$. It is understood that the surface potential remaining ratio $\exp(-t/\tau)$ suddenly rises in the region where $t/\tau$ is about 1, and becomes approximately 1 in the region where $t/\tau$ is less than 0.1.

This shows that the counter charge is almost attenuated and is little left when the time t satisfies the relationship of the $t/\tau>10$, the counter charge is considerably left when the time t satisfies the relationship of $t/\tau<1$, and the counter charge is attenuated little and is mostly left when the time t satisfies the relationship of $t/\tau<0.1$.

Therefore, it is understood that the relationship "T/τ<1" is necessary as the condition for the counter charge generated in the toner supplying portion 11 to be left in the recovering portion 12.

T is the value decided by the width of the supplying nip portion and the circumferential speed of the developer carrier 13, and those values can be obtained by calculation. The attenuation time constant τ can be decided by practical measurement by the following method.

The counter charge generated in the developer in the supplying portion in the supplying nip portion 11 can be kept without being attenuated until it reaches the recovering portion 12 in the supplying nip portion by setting the development device so that thus obtained T/τ satisfies the condition of "T/τ<1". Consequently, the recovery of the post-development residual toner on the toner carrier 7 is facilitated and the occurrence of the development hysteresis (ghost) is reduced.

(Method for Measuring the Attenuation Time Constant of the Developer Layer)

Figure 5:
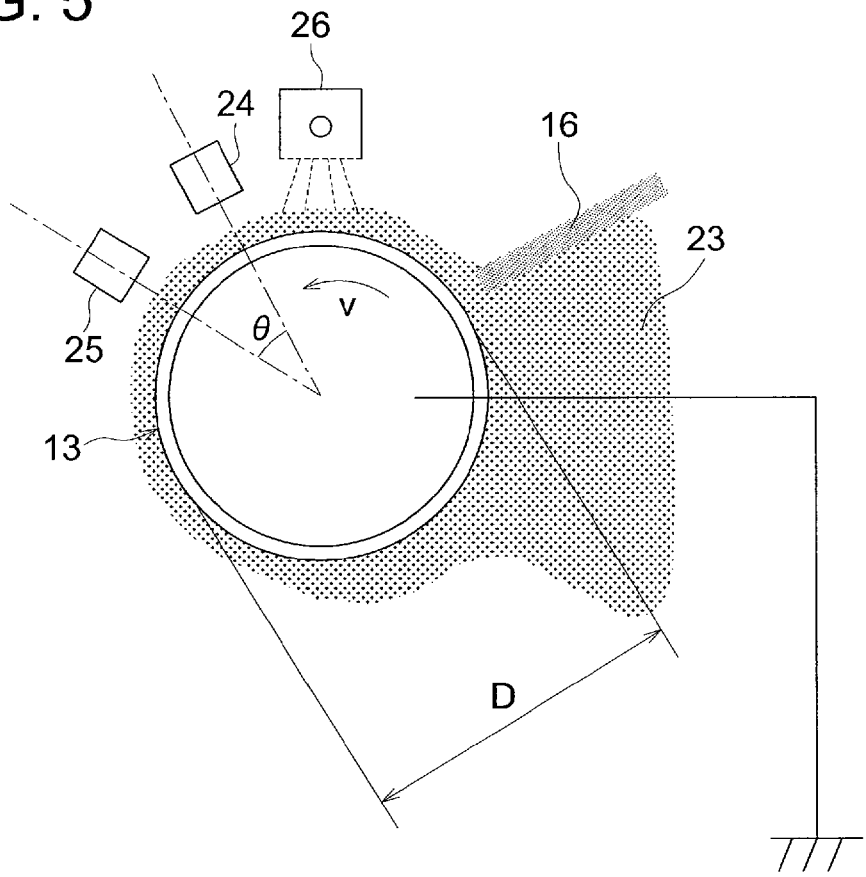
FIG. 5 shows a schematic diagram showing a method for measuring an attenuation time constant $\tau$ (=CR) of the developer layer 23.

In FIG. 5, the schematic drawing of the method for measuring the attenuation time constant τ (=CR) of the developer layer is displayed.

In the development device 2 of FIG. 1, charge is supplied by using a scorotron charging device 26 onto the surface of the developer layer 23, on the developer carrier 13, having passed the regulating member 16 while rotating, in the state where the toner carrier 7 is removed. The developer carrier 13 is grounded.

The surface of the developer layer 23 is charged, and a situation where the counter charge is caused just after the toner supply is simulated. Preferable charged potential is approximately from 200 to 1,000 V.

A first surface potentiometer 24 and a second potentiometer 25 are arranged at respective two positions facing the developer layer having been charged, and the surface potential is measured at each of the positions. The potential of the developer layer measured by the first potentiometer 24 and that measured by the second potentiometer 25 are referred to as V1 (V) and V2 (V), respectively.

The attenuation of V1 measured by the first potentiometer 24 conforms to Equation 1 in the same way as the attenuation of the counter charge. Here, V1 corresponds to V0 in Equation 1. Therefore, the following Equation 2 is obtained using CR=τ.

$$V(t)=V1\times\exp(-t/\tau) \quad (2)$$

In Equation 2, when the time for the developer carrier 13 to rotate from the position facing the first potentiometer 24 to the position facing the second potentiometer 25 is referred to as t12 (s), the surface potential is V2 when the time is t=t12. Consequently, the following Equation 3 is obtained regarding the voltage V2 measured by the second potentiometer 25.

$$V2=V1\times\exp(-t12/\tau) \quad (3)$$

where t12 can be calculated by the following Equation 4 from the rotating speed v (mm/s) of the developer carrier 13, the diameter D of the developer carrier 13, and the angle θ (deg) formed by the two lines: the line connecting the position, on the developer carrier 13, facing to the first potentiometer 24 and the center of the developer carrier 13, and the line connecting the position, on the developer carrier 13, facing the second potentiometer 25 and the center of the developer carrier 13.

$$t12=\pi D\times\theta/360/v \quad (4)$$

From the above equation, τ can be substituted by the following Equation 5, $$\tau=t12/(\log V1-\log V2) \quad (5)$$

where t12=πD×θ/360/v.

τ can be actually obtained based on the conditions D, v, and θ for the measurement, and the detected values by the potentiometers 24 and 25.

EXAMPLES

Advantages of the embodiment were confirmed by using the image forming apparatus shown in FIG. 1.

Experiment 1

In examples 1 to 4 and comparative examples 1 to 5, different kinds of developers each different in the attenuation time constant τ (=CR) were used. The details are described in Table 1.

TABLE 1

| | Kind of carrier | Dynamic resistance (Ω) | Attenuation time constant τ (=CR) | Rotating direction | Magnetic pole position | Developer carrier Speed (mm/s) | Developer carrier Diameter (mm) |
|---|---|---|---|---|---|---|---|
| **1 | I | 3.9E+12 | 1.2E+01 | Counter | *1 | 500 | 30 |
| **2 | H | 2.8E+11 | 8.9E−01 | Counter | *1 | 500 | 30 |
| **3 | G | 4.8E+10 | 1.6E−01 | Counter | *1 | 500 | 30 |
| **4 | F | 4.7E+09 | 1.5E−02 | Counter | *1 | 500 | 30 |
| Comp. 1 | E | 5.3E+08 | 1.7E−03 | Counter | *1 | 500 | 30 |
| Comp. 2 | D | 1.5E+08 | 4.9E−04 | Counter | *1 | 500 | 30 |
| Comp. 3 | C | 5.5E+07 | 1.8E−04 | Counter | *1 | 500 | 30 |
| Comp. 4 | B | 1.4E+07 | 4.4E−05 | Counter | *1 | 500 | 30 |
| Comp. 5 | A | 3.0E+06 | 9.8E−06 | Counter | *1 | 500 | 30 |

| | Width of Nip portion (mm) | T(s) | T/τ | Condition T/τ < 1 | Surface potential remaining ratio (%) | Ghost occurrence |
|---|---|---|---|---|---|---|
| **1 | 3 | 0.006 | 4.8E−04 | Satisfied | 99.95 | A |
| **2 | 3 | 0.006 | 6.7E−03 | Satisfied | 99.33 | A |
| **3 | 3 | 0.006 | 3.9E−02 | Satisfied | 96.22 | A |
| **4 | 3 | 0.006 | 4.0E−01 | Satisfied | 67.26 | B |
| Comp. 1 | 3 | 0.006 | 3.5E+00 | Not satisfied | 2.88 | C |

TABLE 1-continued

| | | | | | | |
|---|---|---|---|---|---|---|
| Comp. 2 | 3 | 0.006 | 1.2E−01 | Not satisfied d | 0.00 | C |
| Comp. 3 | 3 | 0.006 | 3.4E+01 | Not satisfied | 0.00 | C |
| Comp. 4 | 3 | 0.006 | 1.4E+02 | Not satisfied | 0.00 | C |
| Comp. 5 | 3 | 0.006 | 6.1E+02 | Not satisfied | 0.00 | C |

*1: Upstream side 5°,
**Example,
Comp.: Comparative example

In Table 1, there are listed the values of attenuation time constant τ of the developers measured by the foregoing method, various conditions of the system and values of T obtained from these system conditions, values of T/τ, surface potential remaining ratios in the toner recovering portion calculated from the above data, and evaluation results of ghost on images in the cases where the developers prepared in the different producing conditions are used.

In Experiment 1 shown in Table 1, all the examples, including the comparative examples, satisfied the afore-mentioned first and second conditions in the supplying nip portion.

To put it in other words, the toner carrier and the developer carrier were rotated in the counter direction, and the magnetic pole facing the toner carrier was set at the position sifted by 5° from the center of the nip portion to the upstream side of the rotation direction of the developer carrier.

The nip width represents the width of the supplying nip portion which was determined as the touching width of the magnetic brush to the toner carrier when the developer carrier was rotated facing the stationary toner carrier with a toner layer formed thereon.

The bias (the difference between the average potentials of the toner carrier and the developer carrier) for supplying toner applied between the toner carrier and the developer carrier was set so that the toner amount on the toner carrier was made appropriate to obtain suitable image density, based on the values previously obtained, for each of the conditions, by the following method.

The toner on the toner carrier surface was once removed, and then the toner carrier was rotated one turn while toner was being supplied to the toner carrier by a certain bias voltage. Such an operation was repeated with the supplying bias voltages varied, and the supplying bias voltage for supplying with a toner of 4 g/m$^2$ (the amount for obtaining appropriate image density) was determined. Thus obtained value was set for the image formation.

Carriers A to I were carriers each composed of a magnetic core coated with a coating resin. The kind of the core and the thickness of the coating resin were varied so as to vary the resistance of the carriers.

Carrier A to I were in order of size, smallest to largest in resistance thereof. As a result, the values of dynamic resistance and τ (=CR) were made larger in the order of Carrier A to Carrier I. Here, the value of τ (=CR) was varied mostly by changing the resistance of the carrier in the developer.

As shown in Table 1, the foregoing third condition in the nip portion, T/τ<1, was satisfied in Examples 1 to 4 and not satisfied in Comparative Examples 1 to 5. Evaluation images were printed for Examples and Comparative Examples to evaluate the occurrence of ghost.

Figure 6:
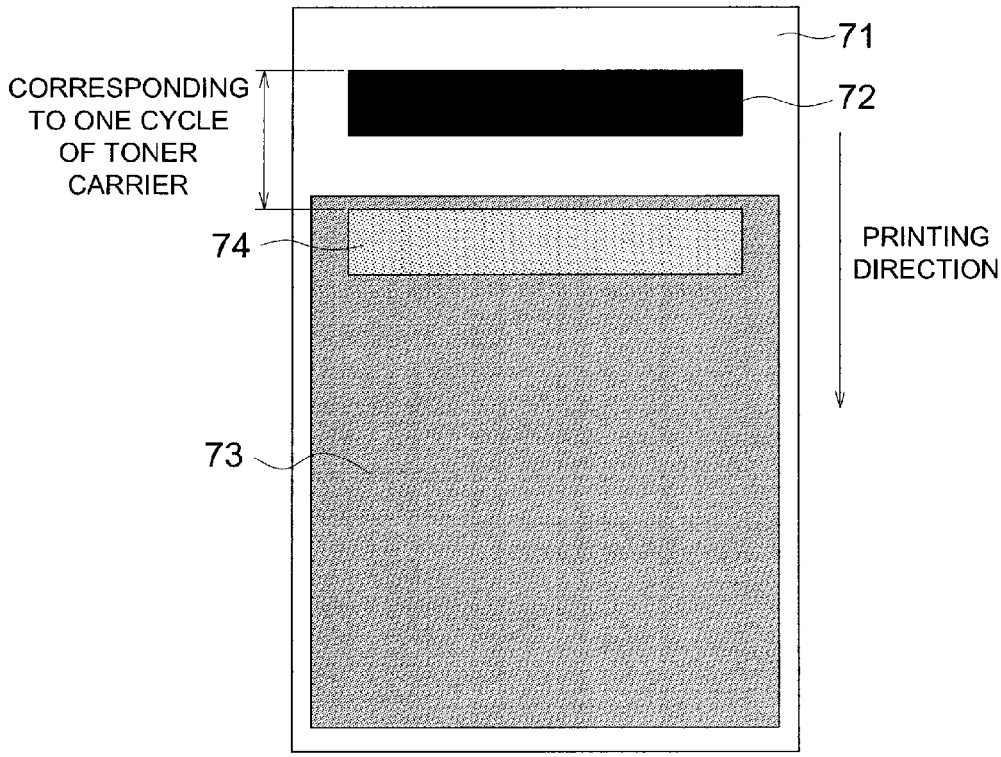
FIG. 6 shows an example of an image with a development hysteresis (ghost) which is prepared by printing a chart for evaluating the occurrence of ghost.

FIG. 6 shows an example of printed image of the evaluation chart, on which a development hysteresis (ghost) was generated. It is confirmed by visual evaluation whether a ghost 74 is created, on a halftone background 73, at one cycle downstream from a solid black portion 72 on a white background.

The visual evaluation was carried out according to the following norms:

Excellent A: Ghost was not observed at all.

Good B: Ghost was slightly observed but caused no problem to the image quality.

No good C: Ghost was clearly observed and thus caused a problem to the image quality.

Table 1 shows that the evaluation results were A or B when T/τ was smaller than 1 as shown in Examples 1 to 4, and the ghost was reduced. The results were excellent (A) when T/τ was smaller than 0.1 as shown in Examples 1 to 3. Comparative examples 1 to 5 not satisfying the above condition were evaluated as C.

Experiment 2

As for Examples 5 to 9 and Comparative examples 6 to 9, images were formed using three kinds of carriers and in three different image forming speeds for each carrier, thus T/τ are varied. Table 2 shows the details.

TABLE 2

| | Kind of carrier | Dynamic resistance (Ω) | Attenuation time constant τ (=CR) | Rotating direction | Magnetic pole position | Developer carrier Speed (mm/s) | Developer carrier Diameter (mm) |
|---|---|---|---|---|---|---|---|
| **5 | I | 3.9E+12 | 1.2E+01 | Counter | *1 | 1000 | 30 |
| **6 | I | 3.9E+12 | 1.2E+01 | Counter | *1 | 500 | 30 |
| **7 | I | 3.9E+12 | 1.2E+01 | Counter | *1 | 30 | 30 |
| **8 | F | 4.7E+09 | 1.5E−02 | Counter | *1 | 1000 | 30 |
| **9 | F | 4.7E+09 | 1.5E−02 | Counter | *1 | 500 | 30 |
| Comp. 6 | F | 4.7E+09 | 1.5E−02 | Counter | *1 | 30 | 30 |
| Comp. 7 | C | 5.5E+07 | 1.8E−04 | Counter | *1 | 1000 | 30 |
| Comp. 8 | C | 5.5E+07 | 1.8E−04 | Counter | *1 | 500 | 30 |
| Comp. 9 | C | 5.5E+07 | 1.8E−04 | Counter | *1 | 30 | 30 |

TABLE 2-continued

| | Width of Nip portion (mm) | T(s) | T/τ | Condition T/τ < 1 | Surface potential remaining ratio (%) | Ghost occurrence |
|---|---|---|---|---|---|---|
| **5 | 3 | 0.003 | 2.4E−04 | Satisfied | 99.98 | A |
| **6 | 3 | 0.006 | 4.8E−04 | Satisfied | 99.95 | A |
| **7 | 3 | 0.100 | 8.0E−03 | Satisfied | 99.20 | A |
| **8 | 3 | 0.003 | 2.0E−01 | Satisfied | 82.01 | A |
| **9 | 3 | 0.006 | 4.0E−01 | Satisfied | 67.26 | B |
| Comp. 6 | 3 | 0.100 | 6.6E+00 | Not satisfied | 0.13 | C |
| Comp. 7 | 3 | 0.003 | 1.7E+01 | Not satisfied | 0.00 | C |
| Comp. 8 | 3 | 0.006 | 3.4E+01 | Not satisfied | 0.00 | C |
| Comp. 9 | 3 | 0.100 | 5.6E+02 | Not satisfied | 0.00 | C |

*1: Upstream side 5°,
**Example,
Comp.: Comparative example

Results of the experiments were listed in Table 2, in which three kinds of carrier A, F and I were pickup from the carriers used in Table 1, and the image forming speed was varied to vary T, and the evaluation was carried out in the same manner as in Table 1.

In Experiment 2 shown in Table 2, all the examples, including the comparative examples, all satisfied the conditions 1 and 2 in the supplying nip portion the same as in Table 1.

To put it in other words, the toner carrier and the developer carrier were each rotated in the counter direction, and the magnetic pole facing the toner carrier was set at the position sifted by 5°, from the center of the nip portion, on the upstream side of the rotation direction of the developer carrier.

As a result of varying the image forming speed, the circumference speed of the developer carrier was varied in the range from 30 to 1,000 mm/s and the values of T and T/τ were also varied with the circumference speed. Here, the value of τ(=CR) was the same in the same kind of carrier, but the value of T/τ was varied depending on the variation of T.

As shown in Table 2, the foregoing third condition in the supplying nip portion, T/τ<1, was satisfied in Examples 5 to 9 and not satisfied in Comparative Examples 6 to 9. Evaluation images were printed for Examples and Comparative Examples to evaluate the occurrence of ghost.

Similarly to Table 1, the evaluation results were A or B in the case of Examples 5 to 9 in which T/τ was smaller than 1, and the ghost was reduced. The results were excellent (A) when T/τ was smaller than 0.1 such as in Examples 5 to 8. Comparative examples 1 to 5 not satisfying the above third condition were evaluated as C.

Figure 7:
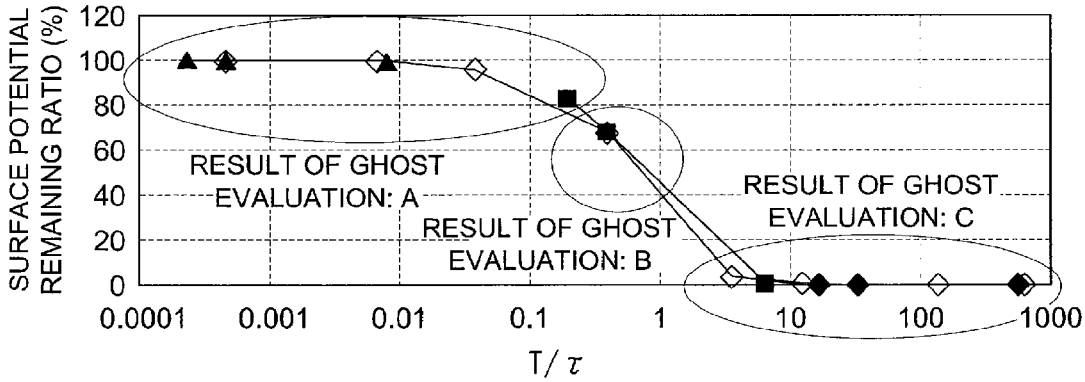

FIG. 7 shows a graph on which the values of T/τ shown in Tables 1 and 2 and the calculated values of surface potential remaining ratio corresponding to each of the T/τ values are plotted, and the evaluation results of the ghost are filled in.

The open diamond represent the results of Table 1, the solid diamond represent the results with Carrier C of Table 2, the solid squares represent the results with Carrier F of Table 2, and the solid triangles represent the results with Carrier I of Table 2.

It was understood that, in the entire cases, the surface potential remaining ratios were commonly raised in the region of T/τ and the occurrence of ghost was reduced accompanied with the rising of the surface potential remaining ratio.

Experiment 3

Comparative Examples 10 to 18 were carried out in the same manner as in Experiment 1 shown in Table 1 except that the position of the magnetic pole facing to the toner carrier in the supplying nip portion was only moved to be sifted by 5° from the center of the nip portion on the downstream side of the rotation direction of the developer carrier. Table 3 shows the details.

TABLE 3

| | Kind of carrier | Dynamic resistance (Ω) | Attenuation time constant τ (=CR) | Rotating direction | Magnetic pole position | Developer carrier Speed (mm/s) | Developer carrier Diameter (mm) |
|---|---|---|---|---|---|---|---|
| Comp. 10 | I | 3.9E+12 | 1.2E+01 | Counter | *1 | 500 | 30 |
| Comp. 11 | H | 2.8E+11 | 8.9E−01 | Counter | *1 | 500 | 30 |
| Comp. 12 | G | 4.8E+10 | 1.6E−01 | Counter | *1 | 500 | 30 |
| Comp. 13 | F | 4.7E+09 | 1.5E−02 | Counter | *1 | 500 | 30 |
| Comp. 14 | E | 5.3E+08 | 1.7E−03 | Counter | *1 | 500 | 30 |
| Comp. 15 | D | 1.5E+08 | 4.9E−04 | Counter | *1 | 500 | 30 |
| Comp. 16 | C | 5.5E+07 | 1.8E−04 | Counter | *1 | 500 | 30 |
| Comp. 17 | B | 1.4E+07 | 4.4E−05 | Counter | *1 | 500 | 30 |
| Comp. 18 | A | 3.0E+06 | 9.8E−06 | Counter | *1 | 500 | 30 |

| | Width of Nip portion (mm) | T(s) | T/τ | Condition T/τ < 1 | Surface potential remaining ratio (%) | Ghost occurrence |
|---|---|---|---|---|---|---|
| Comp. 10 | 3 | 0.006 | 4.8E−04 | Satisfied | 99.95 | C |
| Comp. 11 | 3 | 0.006 | 6.7E−03 | Satisfied | 99.33 | C |

TABLE 3-continued

| | | | | | | |
|---|---|---|---|---|---|---|
| Comp. 12 | 3 | 0.006 | 3.9E−02 | Satisfied | 96.22 | C |
| Comp. 13 | 3 | 0.006 | 4.0E−01 | Satisfied | 67.26 | C |
| Comp. 14 | 3 | 0.006 | 3.5E+00 | Not satisfied | 2.88 | C |
| Comp. 15 | 3 | 0.006 | 1.2E+01 | Not satisfied | 0.00 | C |
| Comp. 16 | 3 | 0.006 | 3.4E+01 | Not satisfied | 0.00 | C |
| Comp. 17 | 3 | 0.006 | 1.4E+02 | Not satisfied | 0.00 | C |
| Comp. 18 | 3 | 0.006 | 6.1E+02 | Not satisfied | 0.00 | C |

*1: Downstream side 5°,
Comp.: Comparative example

The data shown in Table 3 are the results of the similar experiments to those shown in Table 1 except that the position of the magnetic pole facing to the toner carrier is changed; the evaluation is carried out in the same manner as in Table 1.

In Experiment 3 shown in Table 3, the second condition in the supplying nip portion was not satisfied in all the experiments, different from the case of Table 1, although the first condition was satisfied.

To put it in other words, the toner carrier and the developer carrier were rotated in the counter direction to each other, but the position of the magnetic pole facing the toner carrier in the supplying nip portion was located at the position sifted by 5° from the center of the nip portion to the downstream side of the rotation direction of the developer carrier.

The values of T and T/τ were the same as that in Table 1, and Comparative Examples 10 to 13 satisfied the foregoing third condition, namely "T/τ<1", but Comparative Examples 14 to 18 did not satisfy the third condition.

For Comparative Examples 10 to 18, the evaluation images were formed in the same manner as in the case of Table 1, and the occurrence of ghost was evaluated.

Different from the results shown in Table 1, the results of Comparative Examples 10 to 18 were all C, and the ghost was not reduced regardless of whether "T/τ<1" was satisfied or not.

(The Second Condition Regarding the Nip Portion)

The above results show that the ghost reduction effect was not observed when the foregoing first and third conditions were satisfied but the second condition was not satisfied. The following experiment were carried out for investigate the reason for such a result.

The experiments were carried out, using Carrier G (the carrier not causing ghost in the experiments of Table 1), in the same manner as in those shown in Table 1 except that the position of the magnetic pole of the developer carrier facing the toner carrier was changed.

Then the relationship between the supplying bias (the difference between the average potentials of the toner carrier and the developer carrier) and the toner amount supplied onto the toner carrier was measured when the position of the magnetic pole facing the toner carrier was varied in the range from 10° on the downstream side to 15° on the upstream side.

The results are shown in Table 8. In Table 8, the magnetic pole position was set at −10° on the downstream side (solid circle), −5° on the downstream side (solid diamond), ±0° (open square), 5° on the upstream side (open diamond), 10° on the upstream side (open circle), or 15° on the upstream side (open triangle).

As is understood from the results shown in Table 8, the property depends on whether the position of the magnetic pole facing the toner carrier is on the upstream side or the downstream side.

When the position of the magnetic pole is on the downstream side, relatively large supplying bias is required to obtain the designated supplying amount of toner. In contrast, when the position of the magnetic pole is on the upstream side, the necessary toner amount is obtained by relatively low supplying bias.

Therefore, the supplying bias can be lowered by setting the position of the facing magnetic pole at the position on the upstream side of the center of the nip portion. As a result, when the supplying bias is applied, the recovery of the post-development residual toner is not hindered, and the occurrence of the development hysteresis (ghost) is reduced. It is considered that the above effect shows the difference between the results in Table 1 and those in Table 3.

Figure 8:
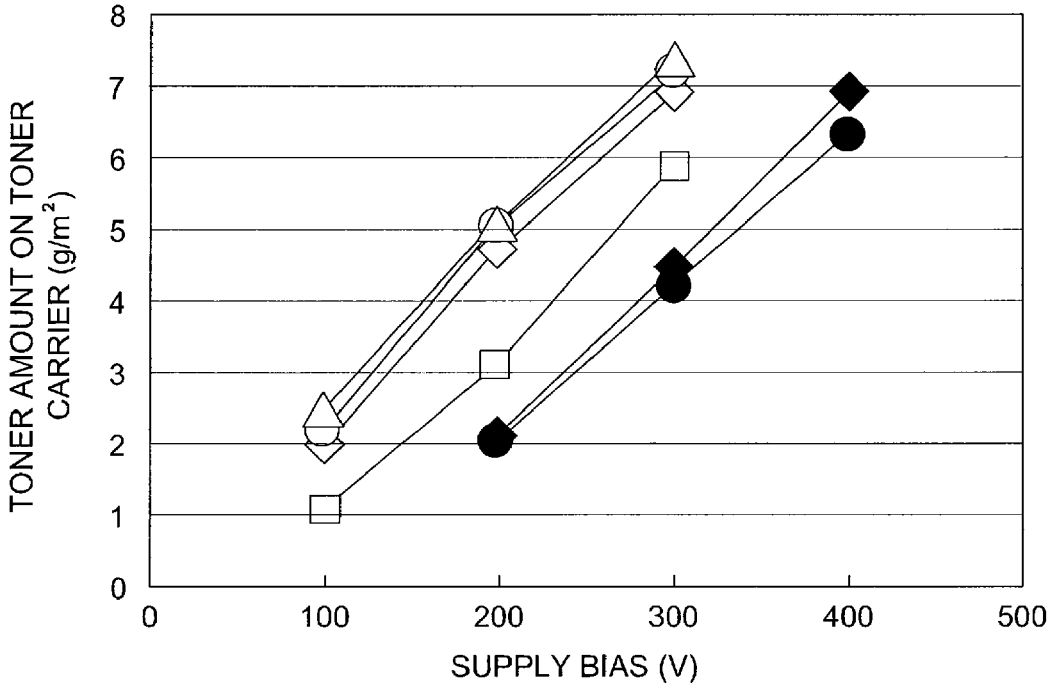
FIG. 8 shows a graph in which the measurement result of the supplied toner amount with respect to the supply bias, assuming the position of facing magnetic pole as a parameter.

The fact that the deterioration in the development hysteresis and change in toner supplying ability shown on FIG. 8 depend on the magnetic pole position can be phenomenologically explained as follows.

Figure 9:
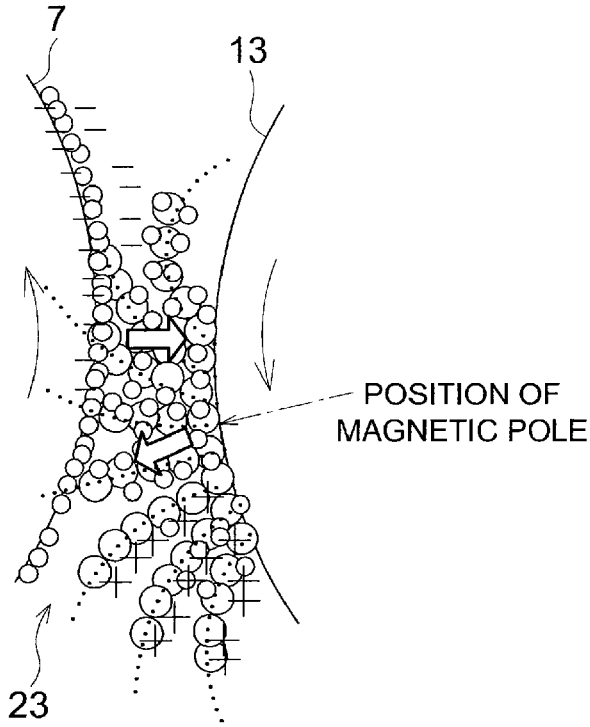
FIG. 9 is a diagram schematically showing the phenomenon occurring near the supplying nip portion when the position of the magnetic pole is located on the downstream side in the counter-rotation.

FIG. 9 is a diagram schematically showing the phenomenon occurring near the supplying nip portion when the position of the magnetic pole is set on the downstream side. When the magnetic pole is positioned on the downstream side, different from the case of that the pole is set on the upstream side, the supply of toner is mainly performed after the magnetic brush passes the closest portion of the supplying nip portion (the lower open arrow in FIG. 9).

Consequently, there is a difference, as follows, between the above arrangement and the arrangement where the magnetic pole is set on the upstream side.

One of the points is that the counter charge cannot be effectively utilized to recover toner since the toner is supplied after passing the closet portion between the toner carrier and the developer carrier, where the recovery of toner is mainly performed (the upper open arrow in FIG. 9), with the result that the toner recovering ability is lowered.

Moreover, the toner layer supplied at the position of the magnetic pole (the lower open arrow in FIG. 9) has passed the closest portion of the toner carrier and the developer carrier, where the recovery is mainly performed. Consequently, a part of the supplied toner is recovered; therefore, the higher bias is necessary so supply toner compared with the case in which the magnetic pole position is on the upstream side.

It is considered that such facts cause the variation of the development hysteresis (ghost) and the variation of the toner supplying ability depending on the position of the magnetic pole.

Experiment 4

As for Comparative Examples 19 to 27, the experiments were carried out in the same manner as in Experiment 1 in Table 1 except that the rotation direction of the toner carrier and the developer carrier at the supplying nip portion are in the with-direction, not the counter-direction. Table 4 shows the details.

TABLE 4

| | Kind of carrier | Dynamic resistance (Ω) | Attenuation time constant τ (=CR) | Rotating direction | Magnetic pole position | Developer carrier Speed (mm/s) | Developer carrier Diameter (mm) |
|---|---|---|---|---|---|---|---|
| Comp. 19 | I | 3.9E+12 | 1.2E+01 | With | *1 | 500 | 30 |
| Comp. 20 | H | 2.8E+11 | 8.9E−01 | With | *1 | 500 | 30 |
| Comp. 21 | G | 4.8E+10 | 1.6E−01 | With | *1 | 500 | 30 |
| Comp. 22 | F | 4.7E+09 | 1.5E−02 | With | *1 | 500 | 30 |
| Comp. 23 | E | 5.3E+08 | 1.7E−03 | With | *1 | 500 | 30 |
| Comp. 24 | D | 1.5E+08 | 4.9E−04 | With | *1 | 500 | 30 |
| Comp. 25 | C | 5.5E+07 | 1.8E−04 | With | *1 | 500 | 30 |
| Comp. 26 | B | 1.4E+07 | 4.4E−05 | With | *1 | 500 | 30 |
| Comp. 27 | A | 3.0E+06 | 9.8E−06 | With | *1 | 500 | 30 |

| | Width of Nip portion (mm) | T(s) | T/τ | Condition T/τ < 1 | Surface potential remaining ratio (%) | Ghost occurrence |
|---|---|---|---|---|---|---|
| Comp. 19 | 3 | 0.006 | 4.8E−04 | Satisfied | 99.95 | C |
| Comp. 20 | 3 | 0.006 | 6.7E−03 | Satisfied | 99.33 | C |
| Comp. 21 | 3 | 0.006 | 3.9E−02 | Satisfied | 96.22 | C |
| Comp. 22 | 3 | 0.006 | 4.0E−01 | Satisfied | 67.26 | C |
| Comp. 23 | 3 | 0.006 | 3.5E+00 | Not satisfied | 2.88 | C |
| Comp. 24 | 3 | 0.006 | 1.2E+01 | Not satisfied | 0.00 | C |
| Comp. 25 | 3 | 0.006 | 3.4E+01 | Not satisfied | 0.00 | C |
| Comp. 26 | 3 | 0.006 | 1.4E+02 | Not satisfied | 0.00 | C |
| Comp. 27 | 3 | 0.006 | 6.1E+02 | Not satisfied | 0.00 | C |

*1: Upstream side 5°,
Comp.: Comparative example

The Table 4 shows the results of the evaluation carried out in the same manner as in Table 1 with only the rotating directions of the toner carrier and the developer carrier being changed.

Also different from Table 1, all the Experiments 4 of Table 4 satisfied the second condition at the supply nip portion, but none of them satisfied the first condition.

To put it in other words, the position of the magnetic pole facing the toner carrier was located on the upstream side of the rotating direction of the developer carrier from the center of the nip portion, but the rotating directions of the toner carrier and the developer carrier were with-direction.

The values of T and T/τ were the same as in Table 1, and Comparative Examples 19 to 22 satisfied the foregoing third condition, namely "T/τ<1", but Comparative Examples 23 to 27 did not satisfy the third condition.

The evaluation image was printed out similarly to the case of Table 1 under the conditions of Comparative Examples 19 to 27 for evaluating the ghost occurrence.

Similar to the results in Table 3, the results of Comparative Examples 19 to 27 were all C and the ghost was not reduced regardless of whether "T/τ<1" was satisfied or not, and the occurrence of ghost was thus not reduced.

Experiment 5

In Comparative Examples 28 to 36, the rotating directions of the toner carrier and the developer carrier in the supplying nip portion were changed and set in the with-direction, not counter-direction. Furthermore, the position of the magnetic pole facing to the toner carrier was set so as to be shift by 5° from the center of the nip portion to the downstream side of the rotation direction of the developer carrier. Table 5 shows the details.

TABLE 5

| | Kind of carrier | Dynamic resistance (Ω) | Attenuation time constant τ (=CR) | Rotating direction | Magnetic pole position | Developer carrier Speed (mm/s) | Developer carrier Diameter (mm) | Width of Nip portion (mm) | T(s) | T/τ | Condition T/τ < 1 | Surface potential remaining ratio (%) | Ghost occurrence |
|---|---|---|---|---|---|---|---|---|---|---|---|---|---|
| Comp. 28 | I | 3.9E+12 | — | With | *1 | 500 | 30 | 3 | 0.006 | — | — | — | C |
| Comp. 29 | H | 2.8E+11 | — | With | *1 | 500 | 30 | 3 | 0.006 | — | — | — | C |
| Comp. 30 | G | 4.8E+10 | — | With | *1 | 500 | 30 | 3 | 0.006 | — | — | — | C |
| Comp. 31 | F | 4.7E+09 | — | With | *1 | 500 | 30 | 3 | 0.006 | — | — | — | C |
| Comp. 32 | E | 5.3E+08 | — | With | *1 | 500 | 30 | 3 | 0.006 | — | — | — | C |
| Comp. 33 | D | 1.5E+08 | — | With | *1 | 500 | 30 | 3 | 0.006 | — | — | — | C |
| Comp. 34 | C | 5.5E+07 | — | With | *1 | 500 | 30 | 3 | 0.006 | — | — | — | C |
| Comp. 35 | B | 1.4E+07 | — | With | *1 | 500 | 30 | 3 | 0.006 | — | — | — | C |
| Comp. 36 | A | 3.0E+06 | — | With | *1 | 500 | 30 | 3 | 0.006 | — | — | — | C |

*1: Downstream side 5°,
Comp.: Comparative example

The data shown in Table 5 shows the results of the similar evaluation to that of Table 1 carried out in the case where the rotating directions of the toner carrier and the developer carrier were changed from Table 1, and the magnet position at the facing portion of the toner carrier and the developer carrier was modified Different from Table 1, in Experiment 4 of Table 4, none of the examples satisfied the conditions 1 or 2 in the supplying nip portion.

To put it in other words, the rotating directions of the toner carrier and the developer carrier were with-direction, and the position of the magnetic pole facing the toner carrier was located on the downstream side of the rotating direction of the developer carrier from the center of the supplying nip portion.

The value of T and T/τ were the same as in Table 1, and Comparative Examples 28 to 31 satisfied the foregoing third condition, namely "T/τ<1", but Comparative Examples 32 to 36 did not satisfy the third condition.

For Comparative Examples 28 to 36, the evaluation images were printed out in the similar manner to the case of Table 1 to evaluate the occurrence of ghost.

Similar to the results of Tables 3 and 4, the results of Comparative Examples 19 to 27 were all C, and the ghost was not reduced regardless of whether "T/τ<1" was satisfied or not, and the occurrence of ghost was not reduced.

(First Condition Regarding the Supplying Nip Portion)

The deterioration of the development hysteresis (ghost) when the rotating directions are in the with-direction is explained as follows.

Figure 10:
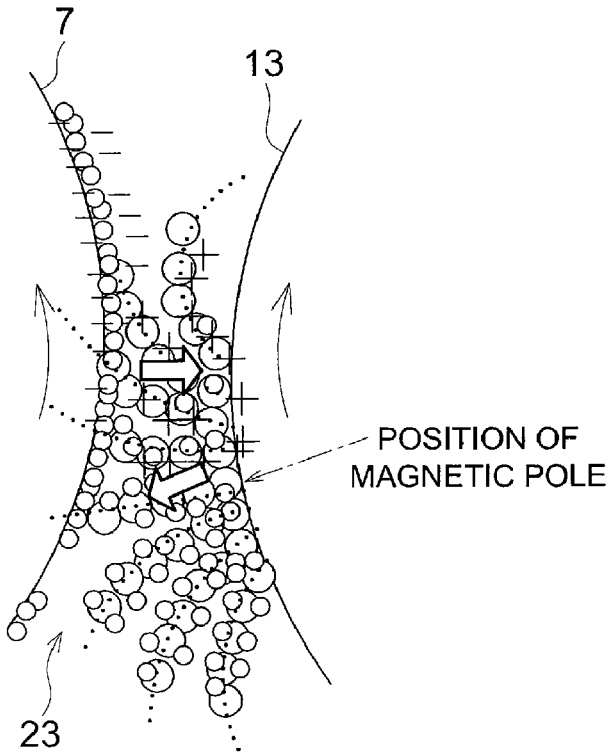
FIG. 10 is a diagram schematically showing the phenomenon occurring near the supplying nip portion when the position of the magnetic pole is located on the upstream side in the with-rotation.

The case in which the position of the magnetic pole is set on the upstream side of the rotating direction of the developer carrier from the center of the supplying nip portion is described referring to FIG. 10. FIG. 10 is a schematic diagram showing the phenomenon occurring near the supplying nip portion when the position of magnetic pole is set on the upstream side under the condition of the with-rotation.

When the magnetic pole is positioned on the upstream side, the supply of toner is mainly performed before the magnet brush passes the supplying nip portion (the lower open arrow in FIG. 10). In such a case, the toner layer supplied at the magnetic pole position (the lower open arrow in FIG. 10) is passed the closest portion of the toner carrier and the developer carrier (the upper open arrow on FIG. 10).

Accordingly, a part of the supplied toner is recovered so that supplying bias needs to be raised compared with the case in which the rotating directions of the toner carrier and the developer carrier are in the counter direction. The higher supplying bias acts to hinder the recovering of the post-development residual toner to the developer carrier side; therefore, the toner recovering ability is lowered and the occurrence of the development hysteresis (ghost) is not reduced.

Moreover, in the case of the with-direction rotation, the brushing force of the magnetic brush acting on the post-development residual toner on the toner carrier gets smaller than in the case of counter-direction rotation since the relative speed is low, thereby lowering the recovering ability. The above-mentioned smaller force is also considered to be a reason for that the occurrence of the development hysteresis (ghost) is not reduced.

Figure 11:
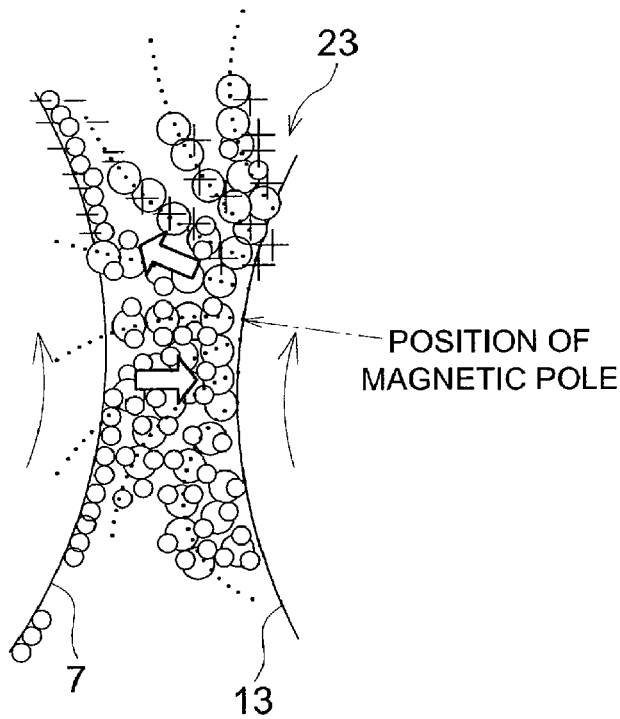
FIG. 11 is a diagram schematically showing the phenomenon occurring near the supplying nip portion when the position of the magnetic pole is located on the downstream side in the with-rotation.

Referring to FIG. 11, a description will be made on the case where the position of magnetic pole is set on the downstream side of the rotating direction of the developer carrier. FIG. 11 schematically shows the phenomenon occurring near the supplying nip portion when the position of the magnetic pole is arranged on the downstream side in the case of with-rotation.

When the magnetic pole position is set on the downstream side, the supply of the toner is mainly performed after the magnetic brush passes the supplying nip portion (the upper open arrow in FIG. 11). In such a case, the toner supply is carried out at the downstream of the closest portion where the recovery is mainly performed, so that the counter charge is not effectively utilized for the toner recovery.

In such a case, the toner recovering ability is lowered and the occurrence of the development hysteresis is not reduced. Moreover, in the case of the with-direction rotation, the brushing force of the magnetic brush acting to the post-development residual toner on the toner carrier is smaller than in the case of counter-direction rotation since the relative speed is low, with the result that the recovering ability is lower. The above-mentioned arrangement is also considered to be a reason for the occurrence of the development hysteresis (ghost) not being reduced.

An embodiment of the invention satisfies the following condition in the supplying nip portion: first, the rotating directions of the toner carrier and the developer carrier are counter directions; second, the magnetic pole is positioned on the upstream side in the rotating direction of the developer carrier; and third, the counter charge generated by the toner supply reaches to the toner recovering portion without being considerably attenuated. The above arrangement provides the following plural advantages: the toner supplying ability is raised at the entrance side of the toner supplying nip portion since the toner supplying nip portion is separated into the toner supplying portion and the toner recovering portion, and the toner recovering ability is raised at the exit side of the toner supplying nip portion where the post-development residual toner is recovered since the counter charge is increased in the exit side of the toner supplying nip portion.

As a result, both of the toner supplying ability and toner recovering ability are raised in the nip portion (toner supplying and recovering portions) so that the high quality images are obtained with reduced occurrence of development hysteresis (ghost), which is a problem in the conventional hybrid development method.

Experiment 6

In order to make clear the difference between the present invention and the conventional technology, the lower limit of the resistance of the carrier for obtaining the advantage of the embodiment of the invention has been investigated.

The experiments shown in Table 6 were carried out in the same manner as the experiments shown in Table 1 except that the speed of the developer carrier was made extremely higher than that conventionally used in the electrophotographic system and the diameter of developer carrier was changed to be so smaller that the supplying nip portion was narrower, thus the evaluation was performed in the similar manner to Table 1.

TABLE 6

| | | Dynamic | Attenuation time | | Magnetic | Developer carrier | |
|---|---|---|---|---|---|---|---|
| | Kind of carrier | resistance (Ω) | constant τ (=CR) | Rotating direction | pole position | Speed (mm/s) | Diameter (mm) |
| **10 | I | 3.9E+12 | 1.2E+01 | Counter | *1 | 1500 | 16 |
| **11 | H | 2.8E+11 | 8.9E−01 | Counter | *1 | 1500 | 16 |

TABLE 6-continued

| | | | | | | | |
|---|---|---|---|---|---|---|---|
| **12 | G | 4.8E+10 | 1.6E−01 | Counter | *1 | 1500 | 16 |
| **13 | F | 4.7E+09 | 1.5E−02 | Counter | *1 | 1500 | 16 |
| **14 | E | 5.3E+08 | 1.7E−03 | Counter | *1 | 1500 | 16 |
| Comp. 37 | D | 1.5E+08 | 4.9E−04 | Counter | *1 | 1500 | 16 |
| Comp. 38 | C | 5.5E+07 | 1.8E−04 | Counter | *1 | 1500 | 16 |
| Comp. 39 | B | 1.4E+07 | 4.4E−05 | Counter | *1 | 1500 | 16 |
| Comp. 40 | A | 3.0E+06 | 9.8E−06 | Counter | *1 | 1500 | 16 |

| | Width of Nip portion (mm) | T(s) | T/τ | Condition T/τ < 1 | Surface potential remaining ratio (%) | Ghost occurrence |
|---|---|---|---|---|---|---|
| **10 | 1.5 | 0.001 | 8.0E−05 | Satisfied | 99.99 | A |
| **11 | 1.5 | 0.001 | 1.1E−03 | Satisfied | 99.89 | A |
| **12 | 1.5 | 0.001 | 6.4E−03 | Satisfied | 96.36 | A |
| **13 | 1.5 | 0.001 | 6.6E−02 | Satisfied | 93.60 | B |
| **14 | 1.5 | 0.001 | 5.9E−01 | Satisfied | 55.36 | B |
| Comp. 37 | 1.5 | 0.001 | 2.0E+00 | Not satisfied | 12.97 | C |
| Comp. 38 | 1.5 | 0.001 | 5.6E+00 | Not satisfied | 0.36 | C |
| Comp. 39 | 1.5 | 0.001 | 2.3E+01 | Not satisfied | 0.00 | C |
| Comp. 40 | 1.5 | 0.001 | 1.0E+02 | Not satisfied | 0.00 | C |

*1: Upstream side 5°,
**Example,
Comp.: Comparative example

The time period to keep the counter charge generated in the supplying portion until the charge reaches the recovering portion is shortened by narrowing the supplying nip portion by using developer carrier with a smaller diameter and raising the speed of the developer carrier.

When the case of a very high speed and a small diameter of the developer carrier is studied, it is made clear how low the resistance of carrier can be practically made.

Figure 12:
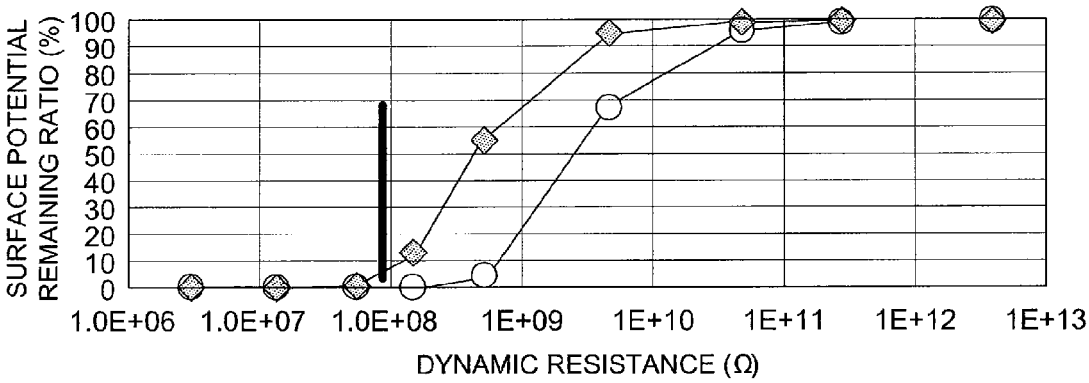
FIG. 12 is a graph in which the results in Table 6 are plotted so as to show the relationship between the dynamic resistance and the surface potential remaining ratio.

FIG. 12 is a diagram showing a graph, on which the relationship between the dynamic resistance and the surface potential remaining ratio of Table 6 is plotted. In FIG. 12, the results of Examples and Comparative Examples of Table 1 are plotted by open circles and those of Table 6 are plotted by solid diamonds.

Table 6 and FIG. 12 show that the advantage of improvement of the recovering ability is not obtained even in such extreme conditions when the dynamic resistance of carriers is not more than about $1\times10^8\Omega$.

From those results, it is clear that at least a resistance of not less than $1\times10^8\Omega$ is necessary as a dynamic resistance of carrier.

<Method for Measuring Dynamic Resistance>

Figure 13:
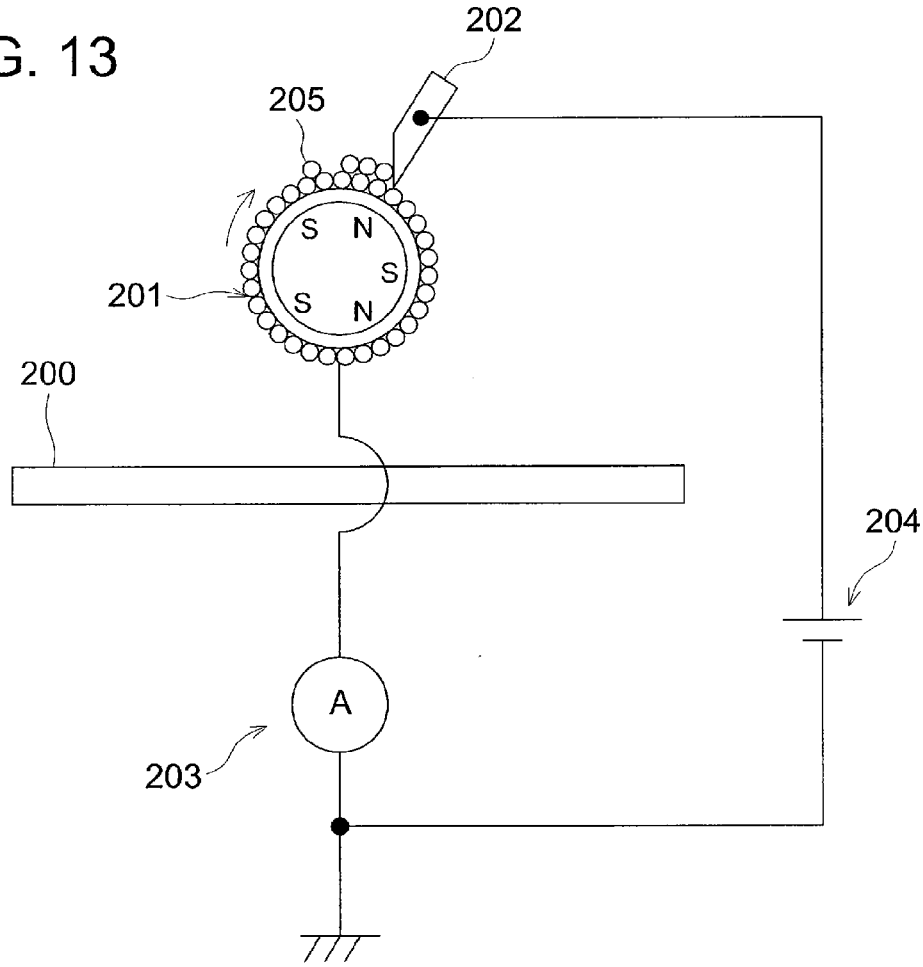
FIG. 13 is a diagram showing a constitutional example of an apparatus for measuring a dynamic resistance.

The measurement of the dynamic resistance (DR) was carried out as follows using the measuring apparatus shown in FIG. 13. FIG. 13 illustrates an example of a dynamic resistance measuring apparatus.

A rotatable sleeve 201 having a diameter of 20 mm and a fixed magnet at a designated interior position thereof was arranged on a grounded stand 200. The surface of the sleeve 201 is faced by a facing electrode (doctor) 202 having a facing area having a width W of 65 mm and a length L of 0.5 to 1 mm with a gap of 0.9 mm.

Then the sleeve 201 was rotated at a rotating speed of 600 rpm (line speed: 628 mm/sec), and the designated amount (14 g) of magnetic particles 205 to be measured were put on the rotating sleeve 201. The magnetic particles were stirred for 10 minutes by the rotation of sleeve 205.

Then electric current IRII (A) between the sleeve 201 and the facing electrode 202 was measured by an ammeter 203.

After that, a voltage E (V) at the maximum withstand level (from 400 V for high-resistance silicone coated carrier, to several volts for iron powder carrier) was applied for 5 minutes to the sleeve 201 from a DC power source 204. In this embodiment, 200 volt was applied.

The current IRQ (A) between the sleeve 201 and the facing electrode 202 was measured by the ammeter 203 while applying the voltage E (V).

From the measured results, the dynamic resistance DR (Ω) was calculated according to the following expression.

$$DR=E/(IRQ-IRII)$$

As above-mentioned, in the development device and the image forming apparatus relating to the embodiment, the nip portion of the toner carrier and the developer carrier is configured to satisfy the following conditions: first, the rotating directions of the toner carrier and the developer carrier are counter directions; second, the magnetic pole is positioned on the upstream side in the rotating direction of the developer carrier; and third, the counter charge generated by the toner supply reaches to the toner recovering portion without being considerably attenuated.

By the above constitution, the toner supplying nip portion is separated into the toner supplying portion and the toner recovering portion so that the toner supplying ability is raised on the entrance side of the toner supplying nip portion, and the counter charge is increased on the exit side of the toner supplying nip portion where the post-development residual toner is recovered, with the result that the toner recovering ability is raised.

As a result, both of the toner supplying ability and the toner recovering ability are raised in the supplying nip portion (toner supplying and recovering portions), and this arrangement provides the high quality images with reduced occurrence of development hysteresis (ghost), which is a problem in the conventional hybrid development method.

The above embodiments are exemplary in all respects and not restrictive. The scope of the invention is represented by the claims, not the above description, and it is intended that the means equivalent to the claims and entire variation within the claims are included in the scope of the invention.

What is claimed is:

1. A development device, comprising:

a toner carrier for carrying toner on a surface thereof and conveying the toner to develop an electrostatic latent image formed on an image carrier with the toner; and a developer carrier rotatably provided facing the toner carrier to form a nip portion between the developer carrier and the toner carrier, the developer carrier including:

a stationarily provided magnet body; and a sleeve roller rotatably provided containing therein the magnet body, the sleeve roller carrying and conveying on a surface thereof, which is a surface of the developer carrier, the developer containing toner and carrier, and configured to supply the toner in the developer to the toner carrier at the nip portion by an electric field while rubbing a surface of the toner carrier with a magnetic brush which is formed of the developer by magnetism of a magnetic pole of the magnet body, wherein the development device is configured to satisfy the following three conditions:

a moving direction of the surface of the developer carrier is opposite, at the nip portion, to a moving direction of the surface of the opposing toner carrier;

the magnetic pole of the magnet body is positioned facing the nip portion so that a peak of a distribution of a magnetic flux density of the magnetic pole is positioned in a range of location where the magnetic brush rubs the surface of the toner carrier, and so that the peak is positioned on an upstream side in a rotating direction of the developer carrier from a closest position at which the toner carrier and the developer carrier are closest to each other; and at the nip portion, the following relationship is satisfied:

$$T/\tau<1$$

wherein:

T is a time period needed for a certain portion of the surface of the developer carrier to pass through an area in which the magnetic brush rubs the surface of the toner carrier in the nip portion; and τ is an attenuation time constant to be used to express an attenuation of a surface potential V(t) generated by a charge caused by the supplying of toner from the developer, in the following equation:

$$V(t)=V0\times\exp(-t/\tau)$$

wherein:

V0 is the surface potential of the developer, at a time t=0, generated by the supply of toner; and V(t) is the surface potential of the developer at a time t.

2. The development device of claim 1, wherein T and the attenuation time constant T satisfy the following relationship:

$$T/\tau<0.1.$$

3. The development device of claim 1, wherein the carrier used in the developer has a dynamic resistance greater than $1\times10^{8}\Omega$.

4. An image forming apparatus, comprising:

an image carrier; and a development device for developing an electrostatic latent image formed on the image carrier, the development device including:

a toner carrier for carrying toner on a surface thereof and conveying the toner to develop an electrostatic latent image formed on an image carrier with the toner; and a developer carrier rotatably provided facing the toner carrier to form a nip portion between the developer carrier and the toner carrier, the developer carrier including:

a stationarily provided magnet body; and a sleeve roller rotatably provided containing therein the magnet body, the sleeve roller carrying and conveying on a surface thereof, which is a surface of the developer carrier, the developer containing toner and carrier, and configured to supply the toner in the developer to the toner carrier at the nip portion by an electric field while rubbing a surface of the toner carrier with a magnetic brush which is formed of the developer by magnetism of a magnetic pole of the magnet body, wherein the development device is configured to satisfy the following three conditions:

a moving direction of the surface of the developer carrier is opposite, at the nip portion, to a moving direction of the surface of the opposing toner carrier;

the magnetic pole of the magnet body is positioned facing the nip portion so that a peak of a distribution of a magnetic flux density of the magnetic pole is positioned in a range of location where the magnetic brush rubs the surface of the toner carrier, and so that the peak is positioned on an upstream side in a rotating direction of the developer carrier from a closest position at which the toner carrier and the developer carrier are closest to each other; and at the nip portion, the following relationship is satisfied:

$$T/\tau<1$$

wherein:

T is a time period needed for a certain portion of the surface of the developer carrier to pass through an area in which the magnetic brush rubs the surface of the toner carrier in the nip portion; and τ is an attenuation time constant to be used to express an attenuation of a surface potential V(t) generated by a charge caused by the supplying of toner from the developer, in the following equation:

$$V(t)=V0\times\exp(-t/\tau)$$

wherein:

V0 is the surface potential of the developer, at a time t=0, generated by the supply of toner; and V(t) is the surface potential of the developer at a time t.

* * * * *

UNITED STATES PATENT AND TRADEMARK OFFICE

CERTIFICATE OF CORRECTION

PATENT NO. : 8,306,464 B2
APPLICATION NO. : 12/776752
DATED : November 6, 2012
INVENTOR(S) : Takeshi Maeyama et al.

It is certified that error appears in the above-identified patent and that said Letters Patent is hereby corrected as shown below:

In column 29, claim 2, line 47, after "attenuation time constant" replace "T" with --τ--.

Signed and Sealed this
Nineteenth Day of February, 2013

Teresa Stanek Rea
*Acting Director of the United States Patent and Trademark Office*